US009016407B2

(12) United States Patent
Durairajan et al.

(10) Patent No.: US 9,016,407 B2
(45) Date of Patent: Apr. 28, 2015

(54) DRILL BIT CUTTING STRUCTURE AND METHODS TO MAXIMIZE DEPTH-OF-CUT FOR WEIGHT ON BIT APPLIED

(75) Inventors: Bala Durairajan, Houston, TX (US); Carl M. Hoffmaster, Houston, TX (US); Michael G. Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 1345 days.

(21) Appl. No.: 12/329,163

(22) Filed: Dec. 5, 2008

(65) Prior Publication Data

US 2009/0145669 A1 Jun. 11, 2009

Related U.S. Application Data

(60) Provisional application No. 61/012,143, filed on Dec. 7, 2007.

(51) Int. Cl.

| | |
|---|---|
| ***E21B 10/00*** | (2006.01) |
| ***E21B 10/58*** | (2006.01) |
| ***E21B 10/43*** | (2006.01) |
| ***E21B 10/55*** | (2006.01) |

(52) U.S. Cl.

CPC ..... *E21B 10/43* (2013.01); *E21B 10/55* (2013.01)

(58) Field of Classification Search

USPC ..... 175/376, 331, 398, 327, 431, 429, 175/420.1, 420.2

See application file for complete search history.

(56) References Cited

U.S. PATENT DOCUMENTS

| | | | |
|---|---|---|---|
| 3,158,216 | A | 11/1964 | Baron et al. |
| 3,344,870 | A | 10/1967 | Morris |
| 4,140,189 | A | 2/1979 | Garner |
| 4,167,980 | A | 9/1979 | Saxman |
| 4,351,401 | A | 9/1982 | Fielder |
| 4,444,281 | A | 4/1984 | Schumacher, Jr. et al. |
| 4,471,845 | A | 9/1984 | Jurgens |

(Continued)

FOREIGN PATENT DOCUMENTS

| | | |
|---|---|---|
| EP | 1096103 | 5/2001 |
| GB | 2294712 | 5/1996 |

(Continued)

OTHER PUBLICATIONS

Baker Hughes Christenson; Quantec Performance Update; 2008 (pp. 10).

(Continued)

*Primary Examiner* — James G Sayre

(57) ABSTRACT

A drill bit for drilling a borehole in earthen formations comprises a bit body including a cone region, a shoulder region, and a gage region. In addition the bit comprises a first primary blade and a second primary blade. Further, the bit comprises a plurality of primary cutter elements mounted to the first primary blade in different radial positions. Still further, the bit comprises a plurality of primary cutter elements mounted to the second primary blade in different radial positions. Moreover, a first primary cutter element of the plurality of primary cutter elements on the first primary blade and a first primary cutter element of the plurality of primary cutter elements on the second primary blade are each positioned in the cone region and are redundant. The shoulder region has a total cutter redundancy percentage that is less than a total cutter redundancy percentage in the cone region.

39 Claims, 12 Drawing Sheets

(56) References Cited

U.S. PATENT DOCUMENTS

| | | | | |
|---|---|---|---|---|
| 4,591,008 | A | 5/1986 | Oliver | |
| 4,602,691 | A | 7/1986 | Weaver | |
| 4,832,136 | A | 5/1989 | Mattsson et al. | |
| 4,932,484 | A | 6/1990 | Warren et al. | |
| 4,936,398 | A | 6/1990 | Auty et al. | |
| 4,991,670 | A | 2/1991 | Fuller et al. | |
| 5,010,783 | A | 4/1991 | Sparks et al. | |
| 5,064,007 | A | 11/1991 | Kaalstad | |
| 5,074,367 | A | 12/1991 | Estes | |
| 5,099,929 | A | 3/1992 | Keith et al. | |
| 5,109,935 | A | 5/1992 | Hawke | |
| 5,145,016 | A | 9/1992 | Estes | |
| 5,145,017 | A | 9/1992 | Holster et al. | |
| 5,186,268 | A | 2/1993 | Clegg | |
| 5,222,566 | A | 6/1993 | Taylor et al. | |
| 5,238,075 | A | 8/1993 | Keith et al. | |
| 5,244,039 | A | 9/1993 | Newton, Jr. et al. | |
| 5,289,889 | A | 3/1994 | Gearhart et al. | |
| 5,407,024 | A | 4/1995 | Watson et al. | |
| 5,456,141 | A | 10/1995 | Ho | |
| 5,494,123 | A | 2/1996 | Nguyen | |
| 5,531,281 | A | 7/1996 | Murdock | |
| 5,549,171 | A | 8/1996 | Mensa-Wilmot et al. | |
| 5,551,522 | A | 9/1996 | Keith et al. | |
| 5,553,581 | A | 9/1996 | Hirabayashi et al. | |
| 5,553,681 | A | 9/1996 | Huffstutler et al. | |
| 5,575,301 | A | 11/1996 | Bolton | |
| 5,582,261 | A | 12/1996 | Keith et al. | |
| 5,592,996 | A | 1/1997 | Keith et al. | |
| 5,607,024 | A | 3/1997 | Keith et al. | |
| 5,607,025 | A | 3/1997 | Mensa-Wilmot et al. | |
| 5,608,162 | A | 3/1997 | Ho | |
| 5,651,421 | A * | 7/1997 | Newton et al. | 175/431 |
| 5,697,462 | A | 12/1997 | Grimes et al. | |
| 5,709,278 | A | 1/1998 | Crawford | |
| 5,746,280 | A | 5/1998 | Scott et al. | |
| 5,755,301 | A | 5/1998 | Love et al. | |
| 5,803,196 | A | 9/1998 | Fielder | |
| 5,816,346 | A | 10/1998 | Beaton | |
| 5,839,526 | A | 11/1998 | Cisneros et al. | |
| 5,862,871 | A | 1/1999 | Curlett | |
| 5,890,550 | A | 4/1999 | Swadi et al. | |
| 5,937,958 | A | 8/1999 | Mensa-Wilmot et al. | |
| 5,979,577 | A | 11/1999 | Fielder | |
| 5,996,713 | A | 12/1999 | Pessier et al. | |
| 6,021,859 | A | 2/2000 | Tibbitts et al. | |
| 6,123,160 | A | 9/2000 | Tibbitts | |
| 6,123,161 | A | 9/2000 | Taylor | |
| 6,164,394 | A | 12/2000 | Mensa-Wilmot et al. | |
| 6,173,797 | B1 | 1/2001 | Dykstra et al. | |
| 6,227,314 | B1 | 5/2001 | Zadrapa et al. | |
| 6,283,233 | B1 | 9/2001 | Lamine et al. | |
| 6,308,790 | B1 * | 10/2001 | Mensa-Wilmot et al. | 175/73 |
| 6,349,780 | B1 | 2/2002 | Beuershausen | |
| 6,408,958 | B1 | 6/2002 | Isbell et al. | |
| 6,427,792 | B1 | 8/2002 | Roberts et al. | |
| 6,481,511 | B2 | 11/2002 | Matthias et al. | |
| 6,536,543 | B2 | 3/2003 | Meiners et al. | |
| 6,575,256 | B1 | 6/2003 | Doster | |
| 6,615,934 | B2 | 9/2003 | Mensa-Wilmot | |
| 6,659,199 | B2 | 12/2003 | Swadi | |
| 6,688,410 | B1 | 2/2004 | Singh et al. | |
| 6,711,969 | B2 | 3/2004 | Meiners et al. | |
| 6,834,733 | B1 | 12/2004 | Maouche et al. | |
| 6,883,623 | B2 | 4/2005 | McCormick et al. | |
| 7,025,156 | B1 | 4/2006 | Caraway | |
| 7,278,499 | B2 | 10/2007 | Richert et al. | |
| 7,621,348 | B2 | 11/2009 | Hoffmaster | |
| 7,726,415 | B1 * | 6/2010 | Tipton et al. | 175/39 |
| 2002/0020565 | A1 | 2/2002 | Hart et al. | |
| 2002/0121393 | A1 | 9/2002 | Thigpen et al. | |
| 2006/0162968 | A1 | 7/2006 | Durairajan et al. | |
| 2006/0185901 | A1 | 8/2006 | Sinor et al. | |
| 2006/0201718 | A1 | 9/2006 | Kembalyan et al. | |
| 2006/0260845 | A1 | 11/2006 | Johnson | |
| 2007/0079995 | A1 | 4/2007 | McClain et al. | |
| 2007/0093996 | A1 | 4/2007 | Cariveau et al. | |
| 2007/0240905 | A1 | 10/2007 | Mensa-Wilmot | |
| 2007/0261890 | A1 * | 11/2007 | Cisneros | 175/331 |
| 2007/0272445 | A1 | 11/2007 | Cariveau et al. | |
| 2008/0135297 | A1 | 6/2008 | Gavia | |
| 2008/0164071 | A1 * | 7/2008 | Patel et al. | 175/431 |
| 2008/0179108 | A1 * | 7/2008 | McClain et al. | 175/431 |
| 2009/0145669 | A1 | 6/2009 | Durairajan et al. | |
| 2009/0301789 | A1 | 12/2009 | Smith et al. | |
| 2010/0000800 | A1 * | 1/2010 | Chen et al. | 175/430 |

FOREIGN PATENT DOCUMENTS

| | | |
|---|---|---|
| GB | 2301852 | 12/1996 |
| GB | 2309242 | 7/1997 |
| GB | 2317195 | 3/1998 |
| GB | 2329203 | 3/1999 |
| GB | 2349661 | 8/2000 |
| GB | 2357534 | 6/2001 |
| GB | 2378718 | 2/2003 |
| GB | 2393982 | 4/2004 |
| GB | 2417967 | 3/2006 |
| GB | 2438053 | 11/2007 |
| GB | 2450222 | 12/2008 |
| WO | 2007098159 | 8/2007 |
| WO | 2008073309 | 6/2008 |

OTHER PUBLICATIONS

Baker Hughes Christenson; Quantec Bit; (pp. 1).

Baker Hughes Christensen; Quantec; Premium PDC drill bits; (pp. 1).

Baker Hughes Christensen; Quantec Brochure, 2008; (pp. 8).

Halliburton; Drilling, Evaluation and Gidital Solutions; Security DBS DrillBits; 2007; (pp. 2).

Office Action Dated Jan. 24, 2008 for U.S. Appl. No. 11/382,510; (20 p.).

Response to Office action Dated Jan. 24, 2008 for U.S. Appl. No. 11/382,510; (18 p.).

Final Office Action Dated Aug. 25, 2008 for U.S. Appl. No. 11/382,510; (9 p.).

Response to Final Office Action Dated Aug. 25, 2008 for U.S. Appl. No. 11/382,510; (15 p.).

Office Action Dated Feb. 10, 2009 for U.S. Appl. No. 11/382,510; (12 p.).

Office Action dated Jul. 9, 2008 for U.S. Appl. No. 11/760,933; (16 p.).

Response to Office Action Dated Jul. 9, 2008 for U.S. Appl. No. 11/760,933; (25 p.).

Final Office Action Dated Jan. 23, 2009 for U.S. Appl. No. 11/760,933; (24 p.).

Response to Final Office Action Dated Jan. 23, 2009 for U.S. Appl. No. 11/760,933; (19 p.).

Advisory Action Dated Apr. 2, 2009 for U.S. Appl. No. 11/760,933; (3 p.).

Office Action Dated Oct. 30, 2008 for U.S. Appl. No. 11/866,333; (13 p.).

Response to Office Action Dated Oct. 30, 2008 for U.S. Appl. No. 11/866,333; (22 p.).

Notice of Allowance and Fee(s) Due dated Apr. 21, 2009 for U.S. Appl. No. 11/866,333; (10 p.).

Canadian Office Action dated Mar. 9, 2009 for U.S. Appl. No. 2,587,287; (3 p.).

Combined Search and Examination Report for Appl. No. GB0708446.0 dated Aug. 9, 2007; (2 p.).

Examination Report for Appl. No. GB0708446.0 dated Nov. 14, 2008; (2 p.).

Combined Search and Examination Report for Appl. No. GB0810112.3 dated Jul. 29, 2008; (4 p.).

Combined Search and Examination Report for Appl. No. GB0822293.7 dated Apr. 17, 2009; (4 p.).

Combined Search and Examination Report for Appl. No. GB0821536.0 dated Feb. 11, 2009; (2 p.).

(56) References Cited

OTHER PUBLICATIONS

Combined Search and Examination Report for Appl. No. GB0719244.6 dated Jan. 23, 2008; (3 p.).
Notice of Allowance and Fee(s) Due dated Dec. 15, 2009 for U.S. Appl. No. 11/760,933 (8 p.).
Office Action dated Jun. 23, 2009 for U.S. Appl. No. 11/760,933 (17 p.).
Response to Office Action dated Jun. 23, 2009 for U.S. Appl. No. 11/760,933 (20 p.).
Final Office Action dated Oct. 23, 2009 for U.S. Appl. No. 11/760,933 (11 p.).
Request for Continued Examination and Response to Final Office Action dated Jan. 23, 2009 for U.S. Appl. No. 11/760,933 (21 p.).
Response to UK Examination Report Jul. 30, 2008 for Appl. No. 0810112.3 (73 p.).
Examination Report dated Dec. 18, 2009 for Appl. No. 0810112.3 (1 p.).
Combined Search and Examination Report dated Nov. 26, 2009 for Appl. No. 0913701.9 (38 p.).
Response to Combined Search and Examination Report dated Nov. 26, 2009 for Appl. No. 0913701.9 (37 p.).
Response to Examination Report dated Feb. 15, 2010 for Appl. No. 0822293.7 (8 p.).
Examination Report dated Feb. 15, 2010 for Appl. No. 0822293.7 (3 p.).
Response to Combined Search and Examination Report dated Apr. 21, 2009 for Appl. No. 0822293.7 (33 p.).
Response to Examination Report dated Jan. 23, 2008 for Appl. No. 0719244.6 (14 p.).
Response to Examination Report dated Feb. 11, 2009 for Appl. No. 0821536.0 (9 p.).
Search Report and Written Opinion for PCT/US2009/039154 dated Oct. 28, 2009 (10 p.).
Non-final office action dated Nov. 22, 2010 for related U.S. Appl. No. 12/416,202, filed Apr. 1, 2009.
Response filed Feb. 22, 2011 to Non-final office action dated Nov. 22, 2010 for related U.S. Appl. No. 12/416,202, filed Apr. 1, 2009.

* cited by examiner

NEGATIVE BACKRAKE

ZERO BACKRAKE

POSITIVE BACKRAKE

DRILL BIT CUTTING STRUCTURE AND METHODS TO MAXIMIZE DEPTH-OF-CUT FOR WEIGHT ON BIT APPLIED

CROSS-REFERENCE TO RELATED APPLICATIONS

This application claims benefit of U.S. provisional application Ser. No. 61/012,143 filed Dec. 7, 2007, and entitled "Drill Bit Cutting Structure and Methods to Maximize Depth-of-Cut for Weight on Bit Applied," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to earth-boring drill bits used to drill a borehole for the ultimate recovery of oil, gas, or minerals. More particularly, the invention relates to drag bits and to an improved cutting structure for such bits. Still more particularly, the present invention relates to arrangements of cutter elements on drag bits exhibiting decreasing degrees of cutter redundancy moving radially outward towards gage.

2. Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed and found useful in drilling such boreholes. Two predominate types of drill bits are roller cone bits and fixed cutter bits, also known as rotary drag bits. Some fixed cutter bit designs include primary blades, secondary blades, and sometimes even tertiary blades, angularly spaced about the bit face, where the primary blades are generally longer and start at locations closer to the bit's rotating axis. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PDC bit" or "PDC cutter element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is desirable to employ drill bits which will drill faster and longer, and which are usable over a wider range of formation hardness.

The length of time that a drill bit may be employed before it must be changed depends upon a variety of factors. These factors include the bit's rate of penetration ("ROP"), as well as its durability or ability to maintain a high or acceptable ROP.

Moving radially outward from the rotational axis of a PDC bit, the bit face may generally be divided into a radially innermost cone region, a radially outermost gage region, and a shoulder region radially disposed between the cone region and the gage region. Cutter elements in the cone and shoulder regions primarily cut the borehole bottom, while the cutter elements in the gage region primarily ream the borehole sidewall. Due to space constraints, the number of cutter elements in a given region of the bit face typically increases moving radially outward. For instance, the number of cutter elements in the shoulder region is usually greater than the number of cutter elements in the cone region. For a given weight-on-bit (WOB), the fewer the cutter elements in a given region, the greater the cutting force on each cutter element in the region, and hence, the greater the depth-of-cut (DOC) of such cutter elements (the greater the cutting force on a given cutter element, the greater the DOC of the cutter element).

In many conventional PDC bits, the relatively few cutter elements in the cone region are each disposed at a unique radial position relative to the bit axis, and thus, no two cutter elements in the cone region are disposed at the same radial position relative to the bit axis. WOB is shared and divided among cutter elements at unique radial positions, leading to reduced cutting forces, and hence, reduced DOC, for each cutter element disposed at a unique radial position. Preferably, the WOB is sufficient to enable each cutter element to exert a cutting force on the formation that exceeds the rock strength, thereby enabling the cutter elements to positively engage and shear the formation. However, in some cases, an insufficient WOB may result from low rig capacity, concerns over bit deviation under excessive WOB, concerns over perceived cutter element breakage, etc. In such cases, cutter elements disposed at unique radial positions exert further reduced cutting forces on the formation, and therefore, provide a reduced DOC. As a result, such cutter elements may not engage or bite the formation sufficiently to shear the formation, but rather, may tend to grind the formation. Such grinding of cutter elements under insufficient WOB can lead to bit vibrations and associated instability, reduced bit durability, and reduced ROP, particularly in harder formations.

Accordingly, there remains a need in the art for a fixed cutter bit and cutting structure capable of enhancing bit stability, bit ROP, and bit durability. Such a fixed cutter bit would be particularly well received if it offered the potential for enhanced cutting forces for each cutter element and enhanced DOC for each cutter element at a given WOB.

BRIEF SUMMARY OF SOME OF THE PREFERRED EMBODIMENTS

These and other needs in the art are addressed in one embodiment by a drill bit for drilling a borehole in earthen formations. In an embodiment, the drill bit comprises a bit body having a bit axis and a bit face including a cone region, a shoulder region, and a gage region. In addition, the drill bit comprises a first primary blade extending radially along the bit face from the cone region to the gage region. Further, the drill bit comprises a plurality of primary cutter elements mounted to the first primary blade, each primary cutter element on the first primary blade being mounted in a different radial position. Still further, the drill bit comprises a second primary blade extending radially along the bit face from the cone region to the gage region. Moreover, the drill bit comprises a plurality of primary cutter elements mounted to the second primary blade, each primary cutter element on the second primary blade being mounted in a different radial position. A first primary cutter element of the plurality of primary cutter elements on the first primary blade and a first primary cutter element of the plurality of primary cutter elements on the second primary blade are each positioned in the cone region. The first primary cutter element on the first primary blade is redundant with the first primary cutter element on the second primary blade. The cone region has a total cutter redundancy percentage, and the shoulder region has a total cutter redundancy percentage that is less than the total cutter redundancy percentage in the cone region.

Theses and other needs in the art are addressed in another embodiment by a drill bit for drilling a borehole in earthen formations. In an embodiment, the drill bit comprises a bit body having a bit axis and a bit face including a cone region, a shoulder region, and a gage region. In addition, the drill bit comprises a plurality of forward-facing cutter elements disposed in the cone region. Further, the drill bit comprises a plurality of forward-facing cutter elements disposed in the shoulder region. Still further, the bit comprises a plurality of primary cutter elements mounted on the at least one primary blade. Moreover, the drill bit comprises a plurality of forward-facing cutter elements disposed in the gage region. A first and a second of the plurality of cutter elements in the cone region are disposed at the same radial position relative to the bit axis. A first and a second of the plurality of cutter elements in the shoulder region are disposed at the same radial position relative to the bit axis. The cone region has a total cutter redundancy percentage, the shoulder region has a total cutter redundancy percentage, and the gage region has a total cutter redundancy percentage. The total cutter redundancy percentage of the shoulder region is less than the total cutter redundancy percentage in the cone region and the total cutter redundancy percentage in the shoulder region is greater than a total cutter redundancy percentage in the gage region.

Theses and other needs in the art are addressed in another embodiment by a drill bit for drilling a borehole in earthen formations. In an embodiment, the drill bit comprises a bit body having a bit axis and a bit face including a cone region, a shoulder region, and a gage region. In addition, the drill bit comprises a first primary blade extending radially along the bit face from the cone region to the gage region. Further, the drill bit comprises a plurality of primary cutter elements mounted to the first primary blade in different radial positions. Still further, the drill bit comprises a second primary blade extending radially along the bit face from the cone region to the gage region. Moreover, the drill bit comprises a plurality of primary cutter elements mounted to the second primary blade in different radial positions. A first primary cutter element of the plurality of primary cutter elements on the first primary blade is redundant with a first primary cutter element of the plurality of primary cutter elements on the second primary blade. The cone region has a primary blade cutter redundancy percentage and the shoulder region has a primary blade cutter redundancy percentage that is less than the primary blade cutter redundancy percentage in the cone region.

Thus, embodiments described herein comprise a combination of features and advantages intended to address various shortcomings associated with certain prior drill bits and methods of using the same. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

For a more detailed description of the preferred embodiments, reference will now be made to the accompanying drawings, wherein.

DETAILED DESCRIPTION OF SOME OF THE PREFERRED EMBODIMENTS

Figure 1:
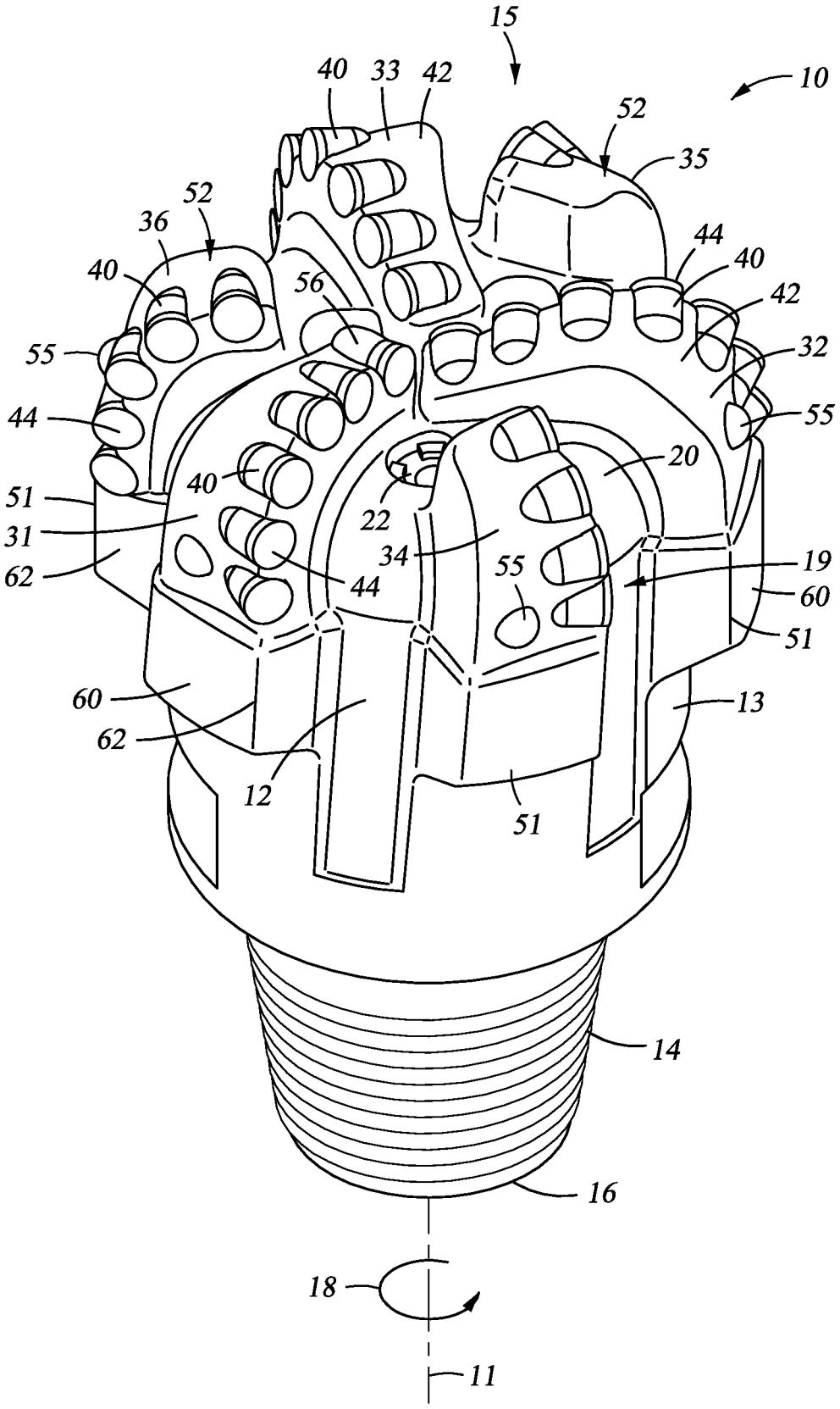
FIG. 1 is a perspective view of an embodiment of a bit made in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Figure 2:
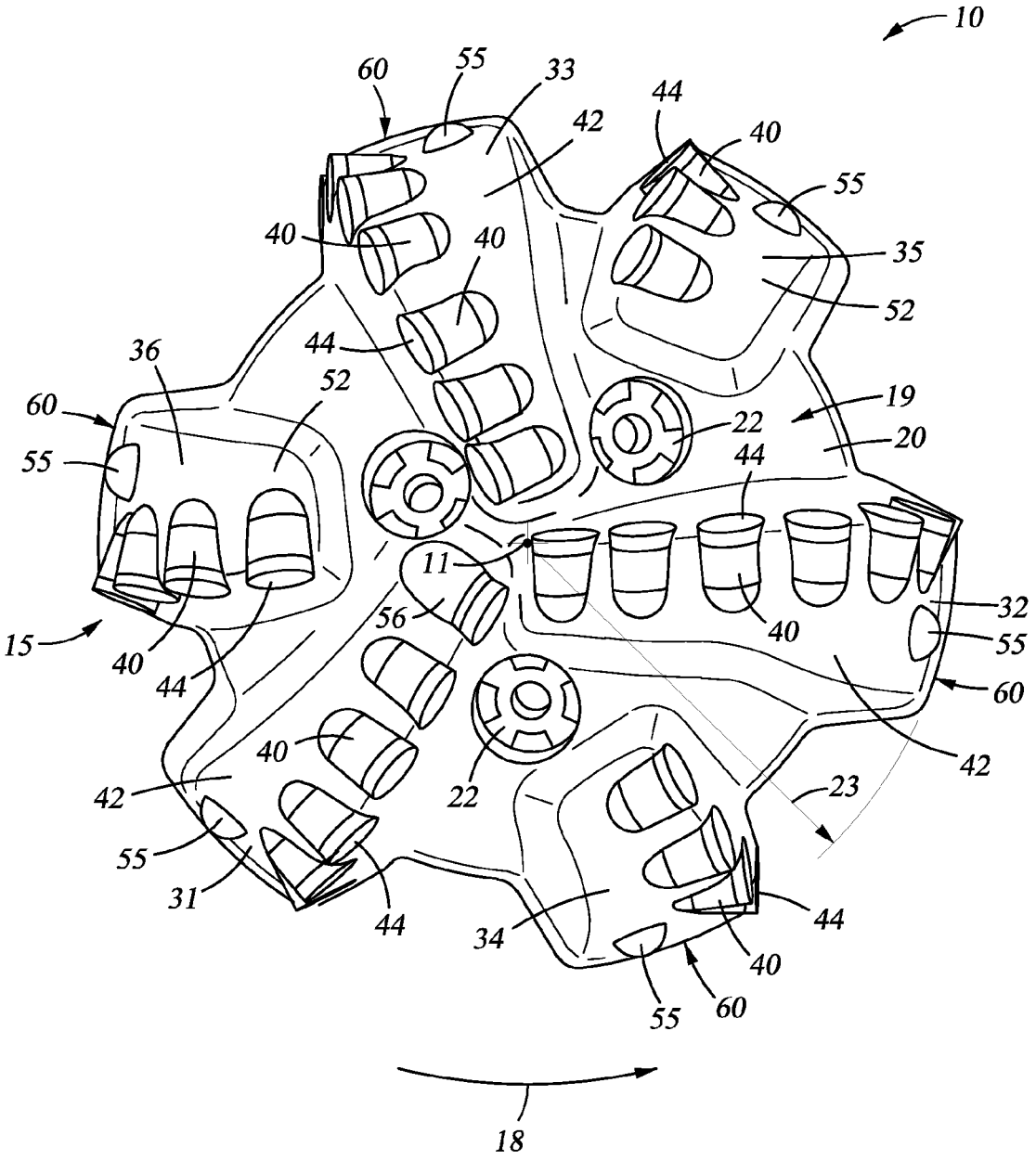
FIG. 2 is a top view of the bit shown in FIG. 1.

Referring to FIGS. 1 and 2, exemplary drill bit 10 is a fixed cutter bit, sometimes referred to as a drag bit, and is preferably a PDC bit adapted for drilling through formations of rock to form a borehole. Bit 10 generally includes a bit body 12, a shank 13 and a threaded connection or pin 14 for connecting bit 10 to a drill string (not shown), which is employed to rotate the bit in order to drill the borehole. Bit face 20 supports a cutting structure 15 and is formed on the end of the bit 10 that faces the formation and is generally opposite pin end 16. Bit 10 further includes a central axis 11 about which bit 10 rotates in the cutting direction represented by arrow 18. As used herein, the terms "axial" and "axially" generally mean along or parallel to the bit axis (e.g., bit axis 11), while the terms "radial" and "radially" generally mean perpendicular to the bit axis. For instance, an axial distance refers to a distance measured along or parallel to the bit axis, and a radial distance refers to a distance measured perpendicular to the bit axis.

Body 12 may be formed in a conventional manner using powdered metal tungsten carbide particles in a binder material to form a hard metal cast matrix. Alternatively, the body can be machined from a metal block, such as steel, rather than being formed from a matrix.

Figure 3:
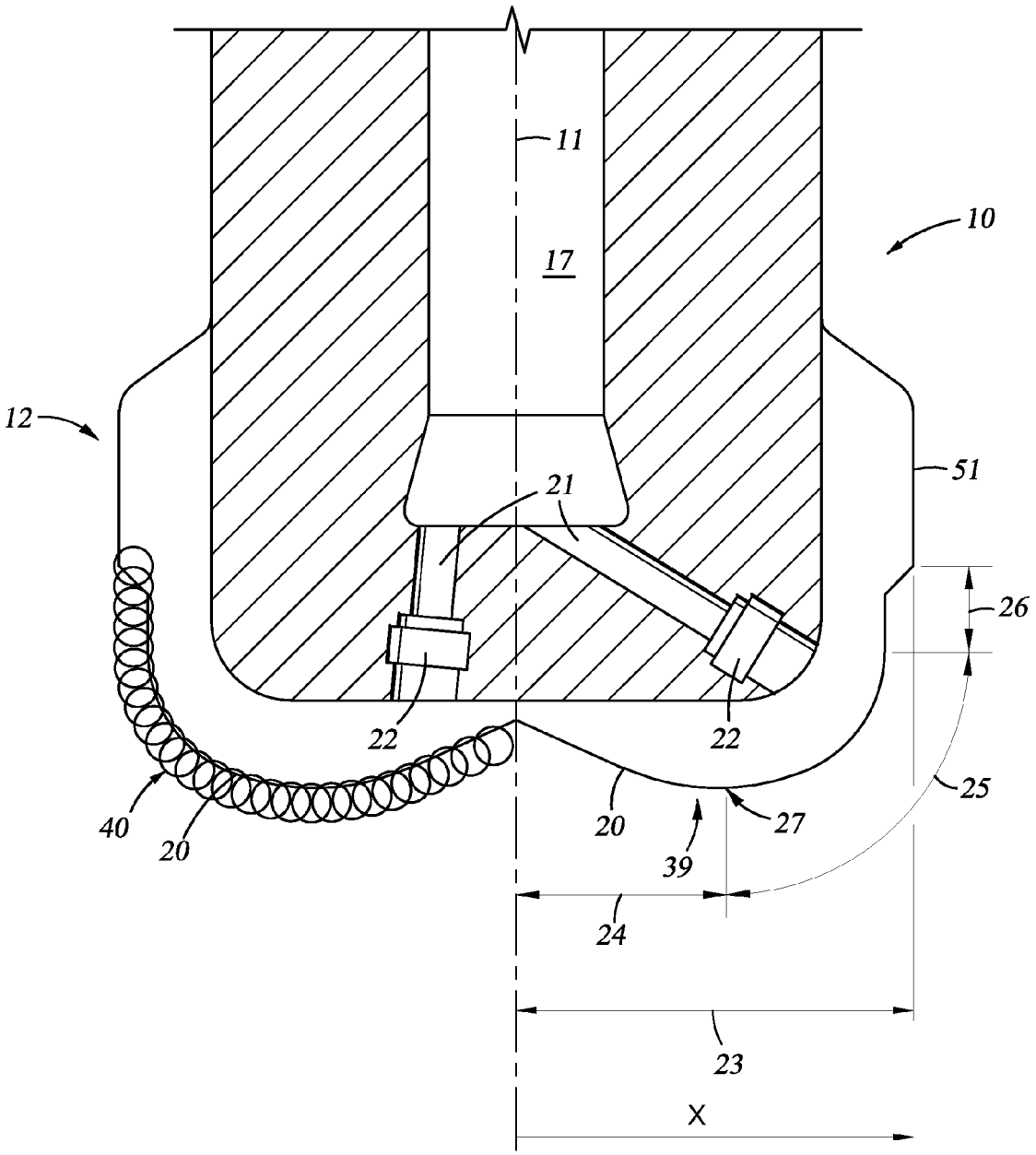
FIG. 3 is a partial cross-sectional view of the bit shown in FIG. 1 with the blades and the cutting faces of the cutter elements rotated into a single composite profile.

As best seen in FIG. 3, body 12 includes a central longitudinal bore 17 permitting drilling fluid to flow from the drill string into bit 10. Body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around a cutting structure 15 to flush away formation cuttings during drilling and to remove heat from bit 10.

Referring again to FIGS. 1 and 2, cutting structure 15 is provided on face 20 of bit 10. Cutting structure 15 includes a plurality of blades which extend from bit face 20. In the embodiment illustrated in FIGS. 1 and 2, cutting structure 15 includes three angularly spaced-apart primary blades 31, 32, 33, and three angularly spaced apart secondary blades 34, 35, 36. In this embodiment, primary blades 31, 32, 33 and secondary blades 34, 35, 36 are circumferentially arranged in an alternating fashion. Further, in this embodiment, the plurality of blades (e.g., primary blades 31, 32, 33 and secondary blades 34, 35, 36) are uniformly angularly spaced on bit face 20 about bit axis 11. In particular, the three primary blades 31, 32, 33 are uniformly angularly spaced about 120° apart, and the three secondary blades 34, 35, 36 are uniformly angularly spaced about 120° apart, and each primary blade 31, 32, 33 is angularly spaced about 60° from each circumferentially adjacent secondary blade 34, 35, 36. In other embodiments, one or more of the blades may be spaced non-uniformly about bit face 20. Still further, primary blades 31, 32, 33 and secondary blades 34, 35, 36 are circumferentially arranged in an alternating fashion. In other words, one secondary blade 34, 35, 36 is disposed between each pair of primary blades 31, 32, 33. Although bit 10 is shown as having three primary blades 31, 32, 33 and three secondary blades 34, 35, 36, in general, bit 10 may comprise any suitable number of primary and secondary blades. As one example only, bit 10 may comprise two primary blades and four secondary blades.

In this embodiment, primary blades 31, 32, 33 and secondary blades 34, 35, 36 are integrally formed as part of, and extend from, bit body 12 and bit face 20. Primary blades 31, 32, 33 and secondary blades 34, 35, 36 extend generally radially along bit face 20 and then axially along a portion of the periphery of bit 10. In particular, primary blades 31, 32, 33 extend radially from proximal central axis 11 toward the periphery of bit 10. Thus, as used herein, the term "primary blade" may be used to refer to a blade that begins proximal the bit axis and extends generally radially outward along the bit face to the periphery of the bit. However, secondary blades 34, 35, 36 are not positioned proximal bit axis 11, but rather, extend radially along bit face 20 from a location that is distal bit axis 11 toward the periphery of bit 10. Thus, as used herein, the term "secondary blade" may be used to refer to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes a cutter-supporting surface 42 for mounting a plurality of cutter elements, and each secondary blade 34, 35, 36 includes a cutter-supporting surface 52 for mounting a plurality of cutter elements. A plurality of primary cutter elements 40, each having a primary cutting face 44, are mounted to cutter-supporting surfaces 42, 52 of each primary blade 31, 32, 33 and each secondary blade 34, 35, 36, respectively. In particular, primary cutter elements 40 are arranged adjacent one another in a radially extending row proximal the leading edge of each primary blade 31, 32, 33 and each secondary blade 34, 35, 36. Consequently, as used herein, the term "primary cutter element" may be used to refer to a cutter element that does not trail, track, or follow any other cutter elements on the same blade when the bit is rotated in the cutting direction.

Although primary cutter elements 40 are shown as being arranged in rows, primary cutter elements 40 may be mounted in other suitable arrangements provided each primary cutter element is either in a leading position. Examples of suitable arrangements may include without limitation, rows, arrays or organized patterns, randomly, sinusoidal pattern, or combinations thereof. In other embodiments, additional rows of cutter elements (e.g., a second or backup row of cutter elements, a tertiary row of cutter elements, etc.) may be provided on one or more primary blade(s), secondary blade(s), or combinations thereof.

In this embodiment, cutter-supporting surfaces 42, 52 also support a plurality of depth-of-cut limiter inserts 55. In particular, one depth-of-cut limiter insert 55 extends from cutter-supporting surfaces 42, 52 of each primary blade 31, 32, 33 and each secondary blade 34, 35, 36, respectively. In this embodiment, each depth-of-cut limiter insert 55 trails the row of primary cutter elements 40 provided on the same blade 31-36.

Each depth-of-cut limiter insert 55 is a generally cylindrical stud having a semi-spherical or dome-shaped end 55*a*. Each depth-of-cut limiter insert 55 is secured in a mating socket in its respective cutter-supporting surface 42, 52 with dome-shaped end 55*a* extending from cutter-supporting surface 42, 52. Depth-of-cut limiter inserts 55 are intended to limit the maximum depth-of-cut of primary cutting faces 44 as they contact the formation. In particular, dome-shaped ends 55*a* of depth-of-cut limiter inserts 55 are intended to slide across the formation and limit the depth to which primary cutting faces 44 engage or bit into the formation. Thus, unlike cutter elements (e.g., primary cutter elements 40), depth-of-cut limiter inserts 55 are not intended to penetrate and shear the formation. Although only one depth-of-cut limiter insert 55 is shown on each blade 31-36, in general, any suitable number of depth-of-cut limiters may be provided on one or more blades of bit 10. In some embodiments, no depth-of-cut limiters (e.g., depth-of-cut limiter inserts 55) are provided. It should be appreciated that depth-of-cut limiter inserts 55 may have any suitable geometry and are not strictly limited to dome-shaped studs.

Referring still to FIGS. 1 and 2, bit 10 further includes gage pads 51 of substantially equal axial length measured generally parallel to bit axis 11. Gage pads 51 are disposed about the circumference of bit 10 at angularly spaced locations. Specifically, gage pads 51 intersect and extend from each blade 31-36. In this embodiment, gage pads 51 are integrally formed as part of the bit body 12.

Each gage pad 51 includes a generally gage-facing surface 60 and a generally forward-facing surface 61 which intersect in an edge 62, which may be radiused, beveled or otherwise rounded. Gage-facing surface 60 includes at least a portion that extends in a direction generally parallel to bit access 11 and extends to full gage diameter. In some embodiments, other portions of gage-facing surface 60 may be angled, and thus slant away from the borehole sidewall. Forward-facing surface 61 may likewise be angled relative to central axis 11 (both as viewed perpendicular to central axis 11 or as viewed along central axis 11). Surface 61 is termed generally "forward-facing" to distinguish that surface from the gage surface 60, which generally faces the borehole sidewall. Gage-facing surface 60 of gage pads 51 abut the sidewall of the borehole during drilling. The pads can help maintain the size of the borehole by a rubbing action when primary cutter elements 40 wear slightly under gage. Gage pads 51 also help stabilize bit 10 against vibration. In other embodiments, one or more of the gage pads (e.g., gage pads 51) may include other structural features including, without limitation, wear-resistant cutter elements or inserts may be embedded in gage pads and protrude from the gage-facing surface or forward-facing surface.

Referring now to FIG. 3, an exemplary profile of bit 10 is shown as it would appear with all blades (e.g., primary blades 31, 32, 33 and secondary blades 34, 35, 36) and primary cutter elements 40 rotated into a single rotated profile. For purposes of clarity, the rotated profile of depth-of-cut limiter inserts 55 are not shown in this view.

In rotated profile view, blades 31-36 of bit 10 form a combined or composite blade profile 39 generally defined by cutter-supporting surfaces 42, 52 of each blade 31-36. Composite blade profile 39 and bit face 20 may generally be divided into three regions conventionally labeled cone region 24, shoulder region 25, and gage region 26. Cone region 24 comprises the radially innermost region of bit 10 and composite blade profile 39 extending generally from bit axis 11 to shoulder region 25. In this embodiment, cone region 24 is generally concave. Adjacent cone region 24 is shoulder (or the upturned curve) region 25. In this embodiment, shoulder region 25 is generally convex. The transition between cone region 24 and shoulder region 25, typically referred to as the nose or nose region 27, occurs at the axially outermost portion of composite blade profile 39 where a tangent line to the blade profile 39 has a slope of zero. Moving radially outward, adjacent shoulder region 25 is the gage region 26 which extends substantially parallel to bit axis 11 at the outer radial periphery of composite blade profile 39. In this embodiment, gage pads 51 extend from each blade 31-36 as previously described. As shown in composite blade profile 39, gage pads 51 define the outer radius 23 of bit 10. Outer radius 23 extends to and therefore defines the full gage diameter of bit 10. As used herein, the term "full gage diameter" is used to describe elements or surfaces extending to the full, nominal gage of the bit diameter.

Still referring to FIG. 3, cone region 24 may also be defined by a radial distance measured from, and perpendicular to, bit axis 11. The radial distance defining the bounds of cone region 24 may be expressed as a percentage of outer radius 23. In the embodiment shown in FIG. 3, cone region 24 extends from central axis 11 to about 40% of outer radius 23. Cone region 24 may also be defined by the radially innermost end of one or more secondary blades (e.g., secondary blades 34, 35, 36). In other words, the cone region (e.g., cone region 24) extends from the bit axis to the radially innermost end of one or more secondary blade(s). It should be appreciated that the actual radius of the cone region of a bit measured from the bit's axis may vary from bit to bit depending on a variety of factors including without limitation, bit geometry, bit type, location of one or more secondary blades, location of cutter elements, or combinations thereof. For instance, in some cases the bit (e.g., bit 10) may have a relatively flat parabolic profile resulting in a cone region (e.g., cone region 24) that is relatively large (e.g., 50% of the outer radius). However, in other cases, the bit may have a relatively long parabolic profile resulting in a relatively smaller cone region (e.g., 30% of the outer radius).

Figure 4:
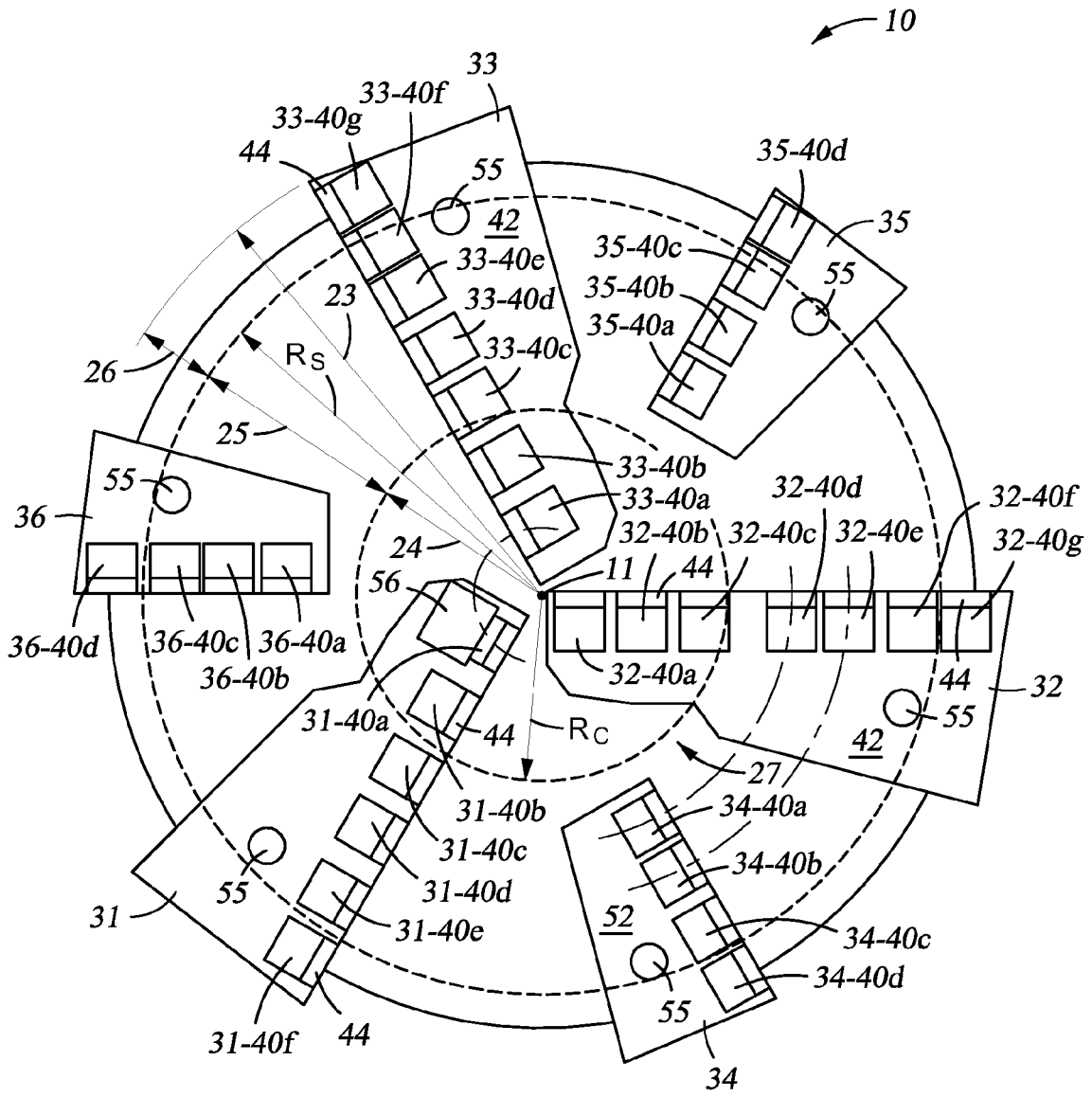
FIG. 4 is a schematic top view of the bit shown in FIG. 1.

Referring now to FIG. 4, a schematic top view of bit 10 is illustrated. For purposes of clarity, nozzles 22 are not shown in this view. Moving radially outward from bit axis 11, bit face 20 includes cone region 24, shoulder region 25, and gage region 26 as previously described. Nose region 27 generally represents the transition between cone region 24 and shoulder region 25. Specifically, cone region 24 extends radially from bit axis 11 to a cone radius $R_c$, shoulder region 25 extends radially from cone radius $R_c$ to shoulder radius $R_s$, and gage region 26 extends radially from shoulder radius $R_s$ to bit outer radius 23.

Primary blades 31, 32, 33 extend radially along bit face 20 from within cone region 24 proximal bit axis 11 toward gage region 26 and outer radius 23. Secondary blades 34, 35, 36 extend radially along bit face 20 from proximal nose region 27 toward gage region 26 and outer radius 23. In this embodiment, secondary blades 34, 35, 36 do not extend into cone region 24, and thus, secondary blades 34, 35, 36 occupy no space on bit face 20 within cone region 24. In other embodiments, the secondary blades (e.g., secondary blades 34, 35, 36) may extend to and/or slightly into the cone region (e.g., cone region 24). In this embodiment, each primary blade 31, 32, 33 and each secondary blade 34, 35, 36 extends substantially to gage region 26 and outer radius 23. However, in other embodiments, one or more primary and/or secondary blades may not extend completely to the gage region or outer radius of the bit.

Referring still to FIG. 4, primary blades 31, 32, 33 and secondary blades 34, 35, 36 provide cutter-supporting surfaces 42, 52, respectively, for mounting primary cutter elements 40 as previously described. In this embodiment, six primary cutter elements 40 arranged in a row are provided on primary blade 31; seven primary cutter elements 40 arranged in a row are provided on primary blade 32; and seven primary cutter elements 40 arranged in a row are provided on primary blade 33. Further, four primary cutter elements 40 arranged in a row are provided on each secondary blade 34, 35, 36. In other embodiments, the number of primary cutter elements (e.g., primary cutter elements 40) on each primary blade (e.g., primary blades 31, 32, 33) and each secondary blade (e.g., secondary blades 34, 35, 36) may differ.

Referring now to FIGS. 1, 2, and 4, each primary cutter element 40 comprises an elongated and generally cylindrical support member or substrate which is received and secured in a pocket formed in the surface of the blade to which it is fixed. In general, each cutter element may have any suitable size and geometry. In this embodiment, each cutter element 40 has substantially the same size and geometry. However, in other embodiments, one or more cutter elements (e.g., primary cutter element 40) may have a different size and/or geometry.

Primary cutting face 44 of each primary cutter element 40 comprises a disk or tablet-shaped, hard cutting layer of polycrystalline diamond or other superabrasive material is bonded to the exposed end of the support member. In the embodiments described herein, each cutter element 40 is mounted such that its cutting face 44 is generally forward-facing. As used herein, "forward-facing" is used to describe the orientation of a surface that is substantially perpendicular to, or at an acute angle relative to, the cutting direction of the bit (e.g., cutting direction 18 of bit 10). For instance, a forward-facing cutting face (e.g., cutting face 44) may be oriented perpendicular to the cutting direction of bit 10, may include a backrake angle, and/or may include a siderake angle. However, the cutting faces are preferably oriented perpendicular to the direction of rotation of bit 10 plus or minus a 45° backrake angle and plus or minus a 45° siderake angle. In addition, each cutting face 44 includes a cutting edge adapted to positively engage, penetrate, and remove formation material with a shearing action, as opposed to the grinding action utilized by impregnated bits to remove formation material. Such cutting edge may be chamfered or beveled as desired. In this embodiment, cutting faces 44 are substantially planar, but may be convex or concave in other embodiments. Each primary cutting face 44 preferably extends to or within 0.080 in. (~2.032 mm) of the outermost cutting profile of bit 10, and more preferably within 0.040 in. (~2.032 mm) of the outermost cutting profile of bit 10 as will be explained in more detail below.

Still referring to the embodiment shown in FIGS. 1, 2, and 4, each primary blade 31, 32, 33 and each secondary blade 34, 35, 36 generally tapers (e.g., becomes thinner) in top view as it extends radially inwards towards central axis 11. Consequently, primary blades 31, 32, 33 are relatively thin proximal axis 11 where space is generally limited circumferentially, and widen towards gage region 26. Although primary blades 31, 32, 33 and secondary blades 34, 35, 36 extend substantially linearly in the radial direction in top view, in other embodiments, one or more of the primary blades, one or more secondary blades, or combinations thereof may be arcuate or curve along their length in top view.

As one skilled in the art will appreciate, numerous variations in the size, orientation, and locations of the blades (e.g., primary blades 31, 32, 33, secondary blades, 34, 35, 36, etc.), cutter elements (e.g., primary cutter elements 40), and the depth-of-cut limiter inserts (e.g., depth-of-cut limiter inserts 55) are possible.

Referring again to FIG. 4, for purposes of clarity and further explanation, primary cutter elements 40 mounted to primary blade 31 are assigned reference numerals 31-40*a-f*, there being six primary cutter elements 40 mounted to primary blade 31; primary cutter elements 40 mounted to primary blade 32 are assigned reference numerals 32-40*a-g*, there being seven primary cutter elements 40 mounted to primary blade 32; and primary cutter elements 40 mounted to primary blade 33 are assigned reference numerals 33-40*a-g*, there being seven primary cutter elements 40 mounted to primary blade 33. Likewise, primary cutter elements 40 mounted to secondary blades 34, 35, 36 are assigned reference numerals 34-40*a-d*, 35-40*a-d*, 36-40*a-d*, respectively, there being four primary cutter elements 40 on each secondary blade 34, 35, 36.

Primary cutter elements 31-40*a, b* of primary blade 31 are disposed in cone region 24, primary cutter elements 32-40*a-c* of blade 32 are disposed in cone region 24, and primary cutter elements 33-40*a, b* are disposed in cone region 24. Thus, in this embodiment, a total of seven cutter elements, each a primary cutter element 40, are disposed in cone region 24. For purposes of the explanation to follow, a cutter element, or any other structure disposed on the bit face, is considered positioned in the region of the bit face (e.g., cone region, shoulder region, or gage region) in which a majority of it lies. Thus, although primary cutter element 32-40*c* slightly crosses the dashed line marking the transition between cone region 24 and shoulder region 25, since the majority of cutter element 32-40*c* is radially disposed within cone region 24 it is considered as being within cone region 24 for purposes of this disclosure.

Referring still to FIG. 4, primary cutter elements 31-40*a* and 33-40*a* in cone region 24 are disposed at the same radial position. In other words, primary cutter elements 31-40*a*, 33-40*a* are disposed at the same radial distance from bit axis 11. As a result, cutter elements 31-40*a*, 33-40*a* are redundant and track each other when bit 10 is rotated in cutting direction 18. As used herein, the term "redundant" may be used to describe a cutter element that is disposed at the same radial position as one or more other cutter element(s) on the same blade or on different blade(s). The description of two or more structures, such as two cutter elements, as being "redundant" or as being at the "same radial position" relative to the bit axis (e.g., bit axis 11) means that the structures are intended to be at the exact same radial position relative to the bit axis. Although such structures are intended to be at the exact same radial position relative to the bit axis, due to manufacturing limitations and associated tolerances, the actual manufactured radial position of such two or more structures may not be identical. Accordingly, as used herein, the phrase "redundant" or "same radial position" is used to describe both of the following: (a) structures that are at the exact same radial position relative to the bit axis, and (b) structures that are, within manufacturing tolerances, disposed at the same actual radial position relative to the bit axis. For most bits, the manufacturing tolerance for the radial position of any given cutter element typically ranges from about +/−0.005 in. (~0.127 mm) to +/−0.030 in. (~0.762 mm).

Although primary cutter elements 31-40*a*, 33-40*a* are redundant, remaining primary cutter elements 31-40*b*, 32-40*a-c*, 33-40*b* in cone region 24 are each disposed at a unique radial positions relative to bit axis 11. In other words, primary cutter elements 31-40*b*, 32-40*a-c*, 33-40*b* are each disposed at a different radial position than every other cutter element on bit 10. Thus, primary cutter elements 31-40*b*, 32-40*a-c*, 33-40*b* do not track any other cutter elements on bit 10, and therefore, are not redundant with any other cutter elements on bit 10. Thus, as used herein, the phrase "unique" is used to describe the radial position of a cutter element that is not redundant and not at the same radial position as any other cutter element on the bit.

The degree of cutter redundancy in cone region 24 may be described in terms of a "total cutter redundancy percentage." As used herein, the phrase "total cutter redundancy percentage" may be used to refer to the percentage of all the cutter elements (e.g., primary cutter elements on primary blades or secondary blades, backup cutter elements on primary blades or secondary blades, etc.) disposed in a particular region of the bit face that are redundant or at the same radial position. In this embodiment, cone region 24 includes a total of seven cutter elements (cutter elements 31-40*a, b*, 32-40*a-c* 33-40*a, b*). In addition, in this embodiment, cone region 24 includes a total of two cutter elements that are redundant with one or more other cutter elements in cone region 24—primary cutter elements 31-40*a*, 33-40*a* are redundant. Thus, in this embodiment, the total cutter redundancy percentage in cone region 24 is about 29% (two redundant cutter elements in cone region 24 divided by seven total cutter elements in cone region 24).

Alternatively, the degree of cutter redundancy in cone region 24 may be described in terms of a "primary blade cutter redundancy percentage." As used herein, the phrase "primary blade cutter redundancy percentage" may be used to refer to the percentage of all the cutter elements mounted to primary blades (e.g., primary cutter elements, backup cutter elements, etc.) disposed in a particular region of the bit face that are redundant. In this embodiment, every cutter element 40 in cone region 24 is disposed on a primary blade 31, 32, 33, and thus, the primary blade cutter redundancy percentage in cone region 24 is the same as the total cutter redundancy percentage in cone region 24, or about 29%. However, as will be described in more detail below, in shoulder region 25 and gage region 26, additional cutter elements 40 are provided on secondary blades 34, 35, 36, and thus, the total cutter redundancy is not necessarily be the same as the primary blade cutter redundancy in such regions.

In most conventional fixed cutter or PDC bits, each cutter element in the cone region is disposed at a unique radial position. As a result, the WOB is divided and shared substantially equally between each of such cutter elements, thereby tending to reduce the cutting force and associated depth-of-cut (DOC) of each individual cutter element in the cone region. In cases where insufficient weight-on-bit (WOB) is applied to such conventional bits, the cutter elements in the cone region may not engage, penetrate, or bite the formation sufficiently to shear the formation. Without being limited by this or any particular theory, WOB is generally divided and shared by cutter elements at different radial positions. Thus, by providing some cutter redundancy in the cone region, embodiments described herein (e.g., bit 10) offer the potential to reduce the number of cutter elements that share WOB, and consequently, offer the potential to increase the cutting force and associated DOC of each cutter element in the cone region for a given WOB as compared to a conventional bit having each cutter element in the cone region disposed at a unique radial position. By increasing the cutting force and associated DOC of each cutter element in the cone region for a given WOB, embodiments described herein also offer the potential to reduce the likelihood of cutter elements grinding or sliding across the formation (as opposed to penetrating and shearing the formation). In this manner, embodiments described herein offer the potential to reduce bit vibrations, improve bit stability, improve bit durability, and improve bit ROP.

Referring still to FIG. 4, primary cutter elements 31-40*c-e*, 32-40*d-f*, 33-40*c-f* are disposed in shoulder region 25. In addition, primary cutter elements 34-40*a-c*, 35-40*a-c*, 36-40*a-c* are disposed in shoulder region 25. Thus, in this embodiment, a total of nineteen cutter elements, all primary cutter elements 40, are disposed in shoulder region 25.

Primary cutter elements 32-40*d* and 34-40*a* in shoulder region 25 are disposed at the same radial position, and therefore, are redundant. In particular, primary cutter element 34-40*a* trails and tracks primary cutter element 32-40*d* when bit 10 is rotated in the cutting direction 10. In addition, cutter elements 32-40*e* and 34-40*b* are disposed at the same radial position, and therefore, are redundant. In particular, primary cutter element 34-40*b* trails and tracks primary cutter element 32-40*e* when bit 10 is rotated in the cutting direction 18. Although primary cutter elements 32-40*d*, 34-40*a* are redundant, and cutter elements 32-40*e*, 34-40*b* are redundant, remaining cutter elements 31-40*c-e*, 32-40*f*, 33-40*c-f*, 34-40*c*, 35-40*a-c*, 36-40*a-c* are each disposed at a unique radial position. Thus, in this embodiment, the total cutter redundancy percentage in shoulder region 25 is about 21% (four redundant cutter elements in shoulder region 25 divided by nineteen total cutter elements in shoulder region 25). Further, in this embodiment, the primary blade cutter redundancy percentage in shoulder region 25 is about 20% (two redundant cutter elements on primary blades in shoulder region 25 divided by ten total cutter elements on primary blades in shoulder region 25).

In this embodiment of bit 10, the total cutter redundancy percentage in shoulder region 25 is less than the total cutter redundancy percentage in cone region 25. Likewise, the primary blade cutter redundancy percentage in shoulder region 25 is less than the primary blade cutter redundancy percentage in cone region 24. Without being limited by this or any particular theory, the cutter elements of a fixed cutter bit positioned in the cone region tend to bear a greater portion of the WOB as compared to the cutter elements in the shoulder region. Further, there generally being fewer cutter elements in the cone region as compared to the shoulder region (due at least in part to space limitations) the average cutting force exerted by a cutter element in the cone region typically exceeds the average cutting force exerted by a cutter element in the shoulder region. Consequently, the cutter elements in the cone region tend to experience greater cutting forces and greater DOC as compared to the cutter elements in the shoulder region. Therefore, without being limited by this or any particular theory, cutter redundancy in the cone region tends to have a greater overall impact on bit stability and ROP as compared to the cutter elements in the shoulder region for a given WOB.

Although cutter redundancy in the cone region may have a greater impact on bit stability for a given WOB as compared to cutter element redundancy in the shoulder region, having at least some cutter elements with unique radial positions in the cone region is desirable to enhance overall bottom hole coverage and bit durability by providing a greater number of cutter elements that actively remove formation material to form the borehole. For instance, by providing a large number of active cutter elements at unique radial positions, the amount of work that is performed by the each cutter is minimized and the stresses placed on each active cutter element is also reduced. This reduces the likelihood of a mechanical failure for the active cutter elements and enhances the durability of the bit. Thus, by selectively providing for increased cutter redundancy in the cone region as compared to the shoulder region, embodiments described herein offer the potential to enhance the impact on DOC for a given WOB, while simultaneously offering the potential to maintain sufficient bottomhole coverage.

Referring still to FIG. 4, primary cutter elements 31-40*f*, 32-40*g*, 33-40*g* of primary blades 31, 32, 33, respectively, are disposed in gage region 26. In addition, primary cutter elements 34-40*d*, 35-40*d*, 36-40*d* of secondary blades 34, 35, 36, respectively, are disposed in gage region 26. Thus, in this embodiment, a total of six cutter elements, each being a primary cutter element 40, are disposed in gage region 26. Further, in this embodiment, there are no redundant cutter elements in gage region 26. Rather, each primary cutter element 31-40*f*, 32-40*g*, 33-40*g*, 34-40*d*, 35-40*d*, 36-40*d* in gage region 26 is disposed at a unique radial position relative to bit axis 11. Thus, in this embodiment, the total cutter redundancy percentage in gage region 26 is 0% (zero total redundant cutter elements in gage region 26 divided by six total cutter elements in gage region 26). Further, in this embodiment, the primary blade cutter redundancy percentage in gage region 26 is also 0% (zero total redundant cutter elements on primary blades in gage region 26 divided by three total cutter elements on primary blades in gage region 26).

In this embodiment, the total cutter redundancy percentage in gage region 26 is less than the total cutter redundancy percentage in shoulder region 25. Likewise, the primary blade cutter redundancy in gage region 26 is less than the primary blade cutter redundancy in shoulder region 25. Without being limited by this or any particular theory, the cutter elements of a fixed cutter bit positioned in the shoulder region tend to bear a significantly greater portion of the WOB applied as compared to the cutter elements in the gage region, which are primary intended ream the borehole sidewall. Consequently, the cutter elements in the shoulder region tend to experience greater cutting forces and greater DOC as compared to the cutter elements in the gage region for a given WOB. Therefore, cutter redundancy in the shoulder region tends to have a greater overall impact on bit stability and ROP as compared to the cutter elements in the gage region for a given WOB.

Although cutter redundancy in the shoulder region may have a greater impact on bit stability for a given WOB as compared to cutter element redundancy in the gage region, having at least some cutter elements with unique radial positions is desirable to enhance overall bottomhole and sidehole coverage. Thus, by selectively providing for greater cutter redundancy in the shoulder region as compared to the gage region, embodiments described herein offer the potential to enhance the impact on DOC for a given WOB by providing a greater degree of cutter element redundancy in the shoulder region as compared to the gage region, while simultaneously offering the potential to maintain sufficient sidehole coverage and improved load distribution at gage by providing less cutter element redundancy in the gage region.

In light of the foregoing description, it should be appreciated that each primary blade 31, 32, 33 includes at least one redundant cutter element—primary cutter elements 31-40*a*, 32-40*d*, 32-40*e*, 33-40*a* are each redundant with at least one other cutter element on bit 10. In addition, secondary blade 34 includes at least one redundant cutter element—cutter elements 34-40*a*, 34-40*b* are redundant with at least one other cutter element on bit 10. However, secondary blades 35, 36 include no redundant cutter elements. In other words, each cutter element 40 on secondary blades 35, 36 is disposed at a unique radial position. As is commonly used in the art, any blade (e.g., primary blade, secondary blade, tertiary blade, etc.) whose cutter elements (e.g., primary cutter elements, backup cutter elements, etc.) are each disposed at a unique radial position may be referred to herein as a "single set" blade. In other words, every cutter element on a single set blade is disposed at a unique radial position. As is also commonly used in the art, any blade whose cutter elements are each redundant with at least one other cutter element on the bit may be referred to herein as a "plural set" blade. In other words, every cutter element on a plural set blade is a redundant cutter element. Although each primary blade 31, 32, 33 in this embodiment includes at least one redundant cutter element 40, and therefore, is not single set, in other embodiments, one or more primary blades may be single set. Further, although no plural set blades are provided in this embodiment of bit 10, in other embodiments, one or more plural set blades may be included.

Referring still to FIG. 4, in this embodiment, each depth-of-cut limiter insert 55 previously described is disposed within shoulder region 25 proximal gage region 26. In particular, each depth-of-cut limiter insert 55 is disposed at the same radial position as a primary cutter element 40 on the same blade. More specifically, depth-of-cut limiter insert 55 on blade 31, 32, 33, 34, 35, 36 is disposed at the same radial position as primary cutter element 31-40*e*, 32-40*e*, 33-40*e*, 34-40*c*, 35-40*c*, 36-40*c*, respectively.

In general, redundant cutter elements track each other during rotation of the bit. Thus, during rotation of the bit, redundant cutter elements follow in essentially the same path. The leading redundant cutter element (relative to the direction of bit rotation) tends to clear away formation material, allowing the trailing redundant cutter element(s) to follow in the path at least partially cleared by the leading cutter element. For example, cutter element 31-40*a*, the leading cutter element of the set of redundant cutter elements 31-40*a*, 33-40*a*, tends to clear away formation material for trailing redundant cutter element cutter element 33-40*a*. As a result, during rotation the trailing redundant cutter elements tend to be subjected to less resistance from the earthen material and less wear than the preceding element. The decrease in resistance reduces the stresses placed on the trailing redundant cutter elements and may improve the durability of the element by reducing the likelihood of mechanical failures such as fatigue cracking. However, by clearing a path for the trailing redundant cutter element(s), the leading redundant cutter element typically experiences significantly greater cutting loads and forces as compared to the trailing redundant cutter element(s). For example, leading redundant cutter element 31-40*a* will typically experience greater cutting loads and forces than trailing redundant cutter element 33-40*a*. Such high loads experienced by the leading cutter element of a set of redundant cutter elements may increase the likelihood of premature damage or breakage to such leading cutter element. Consequently, it may be desirable to provide structural feature(s) to reduce the likelihood of premature damage or breakage of such leading cutter elements in a set of redundant cutter elements. In this embodiment, a depth-of-cut limiter 56 is provided on primary blade 31 behind cutter element 31-40*a* and at the same radial position as cutter element 31-40*a*. As with depth-of-cut limiter inserts 55 previously described, depth-of-cut limiter 56 is intended to slide across the formation, thereby limiting the depth which cutter element 31-40*a* penetrates the formation and the associated the cutting loads experienced by cutter element 31-40*a*. As a result, depth-of-cut limiter 56 offers the potential to protect cutter element 31-40*a* and reduce the likelihood of premature damage and/or breakage to cutter element 31-40*a*. However, unlike depth-of-cut limiter inserts 55 previously described, depth-of-cut limiter 56 is not an insert or stud secured in a mating socket provided in a blade 31-36. Rather, in this embodiment, depth-of-cut limiter 56 is integral with primary blade 31 and bit body 12, and thus, may be referred to as an "integral depth-of-cut limiter" to distinguish it from a depth-of-cut limiter insert (e.g., depth-of-cut limiter insert 55) that is secured in a mating socket provided in the bit body. For example, depth-of-cut limiter 56 may be formed from or milled from the matrix making up bit body 12.

Figure 5:
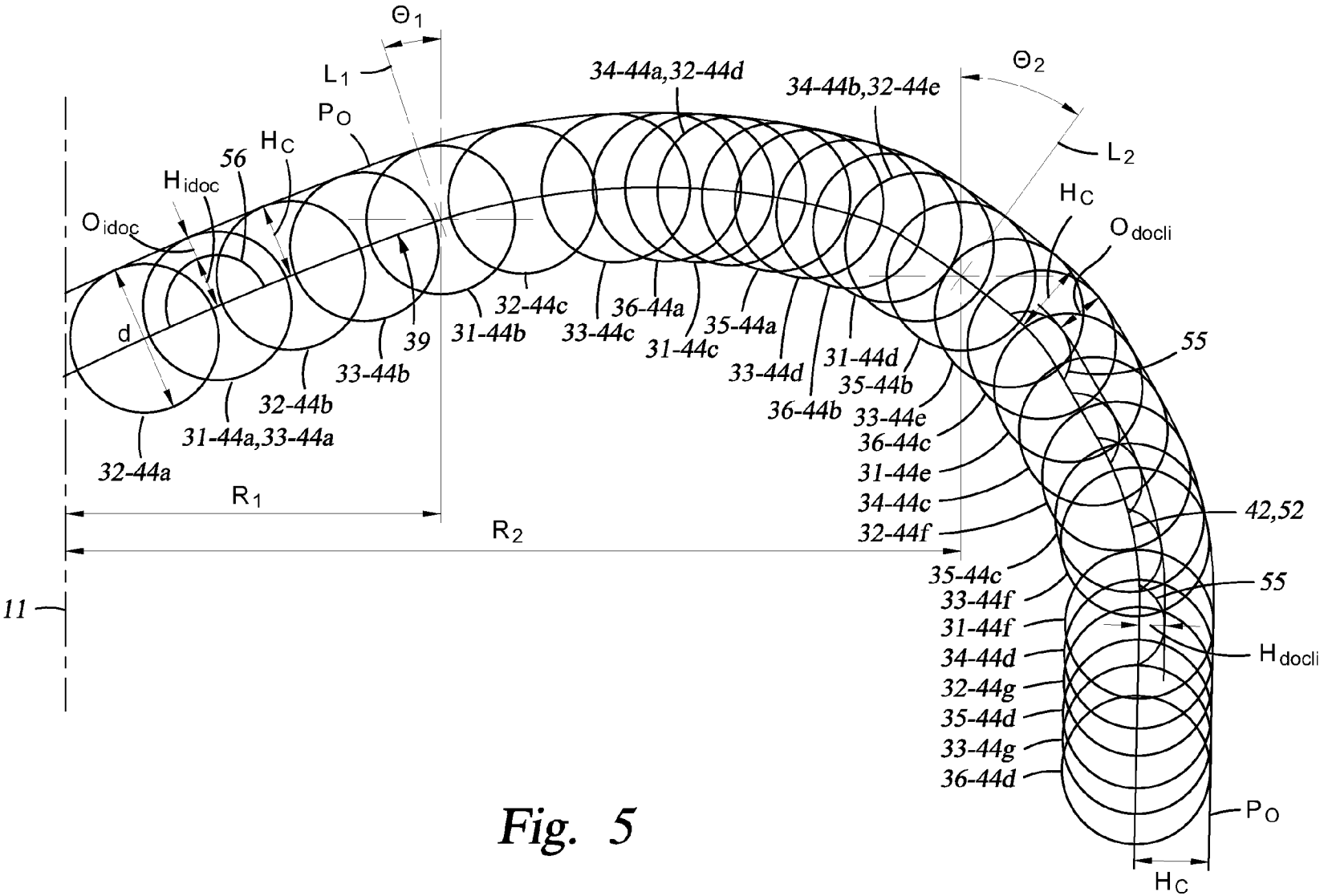
FIG. 5 is an enlarged view of the composite rotated profile of FIG. 3.

Referring now to FIG. 5, the profiles of primary blades 31, 32, 33, secondary blades 34, 35, 36, cutting faces 44, and depth-of-cut limiter inserts 55 are schematically shown rotated into a single composite rotated profile view. For purposes of clarity and further explanation, primary cutting faces 44 of primary cutter elements 31-40*a-f*, 32-40*a-g*, 33-40*a-g* of primary blades 31, 32, 33, respectively, are assigned reference numerals 31-44*a-f*, 32-44*a-g*, 33-44*a-g*, respectively. Likewise, primary cutting faces 44 of primary cutter elements 34-40*a-d*, 35-40*a-d*, 36-40*a-d* mounted to secondary blades 34, 35, 36, respectively, are assigned reference numerals 34-44*a-d*, 35-44*a-d*, 36-44*a-d*, respectively.

In rotated profile view, each primary blade 31, 32, 33 and each secondary blades 34, 35, 36 forms a blade profile generally defined by its cutter-supporting surface 42, 52. In this embodiment, the blade profiles of each primary blade 31, 32, 33 and each secondary blade 34, 35, 36 are substantially the same, each being generally coincident with each other, thereby forming a single composite blade profile 39 previously described with reference to FIG. 3.

Referring still to FIG. 5, each primary cutting face 44 (i.e., each cutting face 31-44*a-f*, 32-44*a-g*, 33-44*a-g*, 34-44*a-d*, 35-44*a-d*, 36-44*a-d*) extends to substantially the same extension height $H_c$ measured perpendicularly from cutter-supporting surfaces 42, 52 (or blade profile 39) to the outermost cutting tip of the cutting face 44. As used herein, the phrase "extension height" may be used to refer to the distance or height to which a structure (e.g., cutting face, depth-of-cut limiter, etc.) extends perpendicularly from the cutter-supporting surface (e.g., cutter-supporting surface 42, 52) of the blade to which it is attached. The tips of cutting faces 44 extending to extension height $H_c$ define an outermost cutting profile $P_o$ that is generally parallel to blade profile 39. In general, the one or more cutting faces (e.g., primary cutting faces 44) having the greatest extension height define the outermost cutting profile of the bit.

As used herein, the phrase "on profile" may be used to describe a structure (e.g., cutter element, depth-of-cut limiter, etc.) that extends from the cutter-supporting surface to the outermost cutting profile (e.g., outermost cutting profile $P_o$) in rotated profile view. Whereas, the phrase "off profile" may be used to refer to a structure extending from the cutter-supporting surface (e.g., cutter element, depth-of-cut limiter insert, etc.) that has an extension height less than the extension height of one or more other cutter elements that define the outermost cutting profile of a given blade. In other words, a structure that is "off profile" does not extend to the outermost cutting profile, and thus, is offset from the outermost cutting profile. In this embodiment, each cutting face 44 extends to outermost cutting profile $P_o$, and thus, each cutting face 44 is "on profile." In other embodiments, one or more cutting faces (e.g., cutting faces 44) may be off profile.

Referring still to FIG. 5, in this embodiment, each depth-of-cut limiter insert 55 extends to substantially the same extension height $H_{docli}$, and integral depth-of-cut limiter 56 extends to an extension height $H_{idoc}$. Depending on a variety of factors including, without limitation, the application, formation hardness, etc., extension height $H_{idoc}$ of integral depth-of-cut limiter 56 may be the same, greater than, or less than extension height $H_{docli}$. Extension height $H_{docli}$ and $H_{idoc}$ are each less than the extension height $H_c$ of primary cutting faces 44, and thus, depth-of-cut limiter inserts 55 and integral depth-of-cut limiter 56 may each be described as being "off profile". In particular, depth-of-cut limiter inserts 55 are offset from outermost cutting profile $P_o$ by an offset distance $O_{docli}$ and integral depth-of-cut limiter 56 is offset from outermost cutting profile $P_o$ by an offset distance $O_{idoc}$. Offset distance $O_{docli}$ is preferably between about 0.040 in. (~1.016 mm) and 0.125 in. (~3.175 mm), and offset distance $O_{idoc}$ is preferably between about 0.010 in. (~0.254 mm) and 0.100 in. (~2.54 mm).

Referring still to FIG. 5, in this embodiment, each primary cutter element 40 has substantially the same cylindrical geometry and size as previously described. In particular, each primary cutting face 44 has substantially the same diameter d. For an exemplary bit 10 having an overall gage diameter of 7.875 in. (~20 cm), diameter d of each cutting face 44 is about 0.625 in. (~16 mm). In other embodiments, the geometry and/or size of one or more primary cutting face and/or one or more backup cutting face may be different.

As a result of the relative sizes and radial positions of redundant primary cutter elements 31-40*a*, 33-40*a*, redundant cutter elements 34-40*a*, 32-40*d*, and redundant cutter elements 34-40*b*, 32-40*e*, primary cutting faces 31-44*a*, 33-44*a*, primary cutting faces 34-44*a*, 32-44*d*, and primary cutting faces 34-44*b*, 32-44*e*, respectively, completely eclipse or overlap each other in rotated profile view.

Although this embodiment of bit 10 includes three sets of redundant primary cutter elements (i.e., redundant primary cutter elements 31-40*a*, 33-40*a*, redundant cutter elements 34-40*a*, 32-40*d*, and redundant cutter elements 34-40*b*, 32-40*e*), each of the other primary cutter elements 40 is disposed at a unique radial position. Although the other primary cutter elements 40 are disposed in different radial positions, due to their relative sizes and positions, their cutting faces 44 at least partially eclipse or overlap with one or more other cutting faces 44 in rotated profile view. In this manner, cutting faces 44 are positioned and arranged to enhance bottomhole coverage.

Referring still to FIG. 5 and for purposes of this disclosure, the radial position of a given cutter element is defined by the radial distance from the bit axis to the point on the cutter supporting surface at which the cutter element is mounted. Specifically, the cutting face of each cutter element may be described as being bisected by a "profile angle line" that is perpendicular to the outermost cutting profile $P_o$ in rotated profile view. Thus, as used herein, the phrase "profile angle line" may be used to refer to a line perpendicular outermost cutting profile in rotated profile view, and that bisects a cutting face in rotated profile view. For example, a profile angle line $L_1$ bisects primary cutting face 33-44*b* of primary cutter element 33-40*b* in rotated profile view. Each profile angle line is oriented at a profile angle θ measured between the bit axis (or a line parallel to the bit axis) and the profile angle line in rotated profile view. Thus, as used herein, the phrase "profile angle" may be used to refer to the angle between a profile angle line and a line parallel to the bit axis in rotated profile view. For example, profile angle line $L_1$ of primary cutting face 33-44*b* is oriented at a profile angle $\theta_1$. The radial position of a given cutter element is the radial distance measured perpendicularly from the bit axis to the intersection of the cutter-supporting surface or blade profile of the blade to which the cutter element is mounted and the profile angle line that is perpendicular to outermost cutting profile and that bisects the cutting face in rotated profile view. For example, as shown in FIG. 5, the radial position of primary cutting face 33-44*b* is defined by a radial distance $R_1$ measured perpendicularly from bit axis 11 to the point of intersection of blade profile 39 and profile angle line $L_1$. As another example, the radial position of primary cutting face 35-44*b* is defined by a radial distance $R_2$ measured perpendicularly from bit axis 11 to the point of intersection of blade profile 49 and profile angle line $L_2$. Profile angle line $L_2$ is perpendicular to outermost cutting profile $P_o$ and bisects primary cutting face 35-44*b*. Further, profile angle line $L_2$ forms a profile angle $\theta_2$ measured between bit axis 11 (or a line parallel to bit axis 11) and first profile line $L_2$.

It should be appreciated that cutter elements having the same radial position share a common profile angle line and have the same profile angle, whereas cutter elements at different radial positions do not share a profile angle line and have different profile angles. Thus, for example, redundant cutter elements 31-40*a*, 33-40*a* share a common profile angle line and have the same profile angle.

Figure 6:
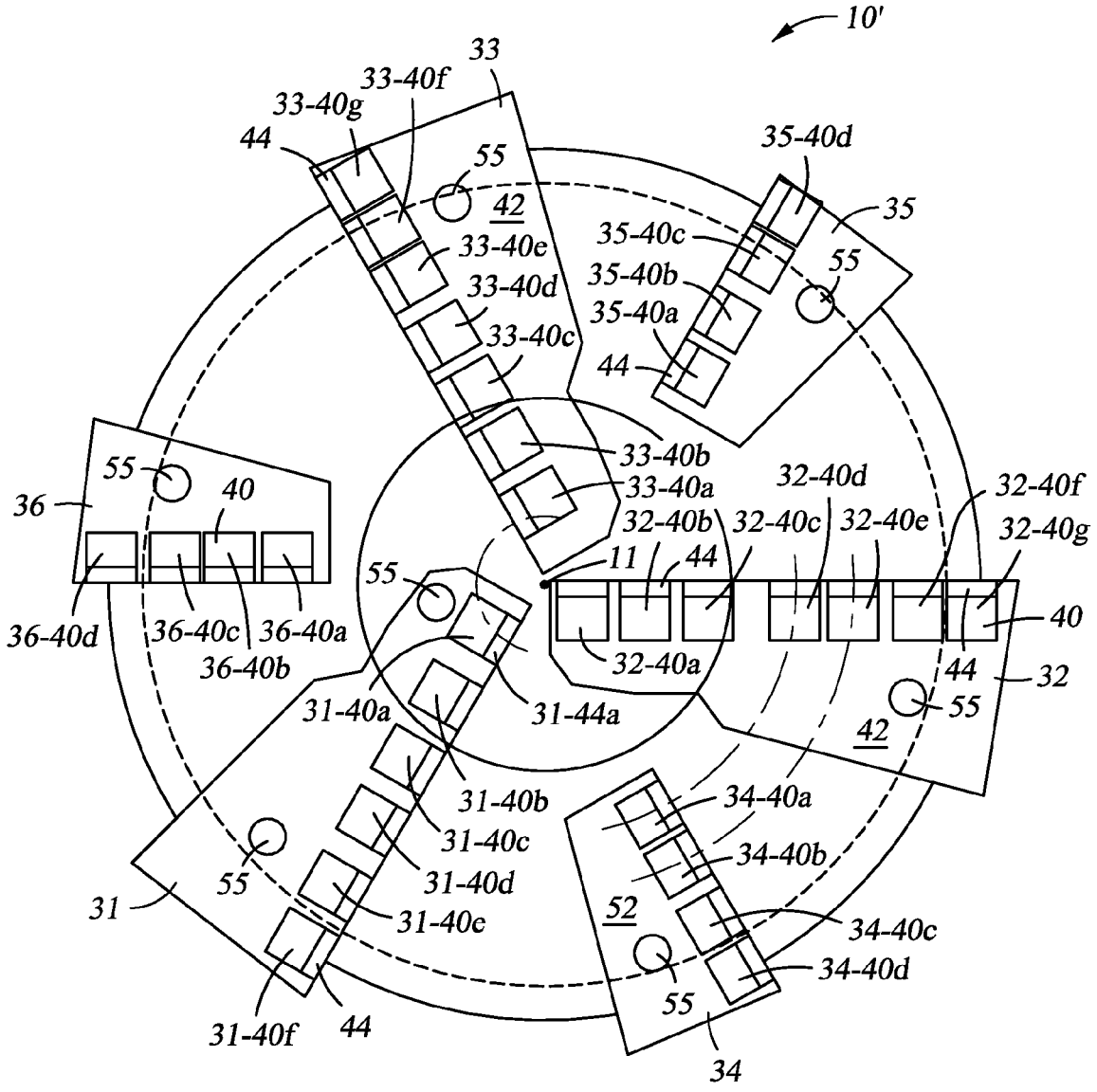
FIG. 6 is a schematic top view of an embodiment of a bit made in accordance with the principles described herein.

As previously described, the leading redundant cutter element of a set of redundant cutter elements typically experiences significantly greater cutting loads and forces as compared to the trailing redundant cutter element(s). For example, leading redundant cutter element 31-40*a* will typically experience greater cutting loads and forces than trailing redundant cutter element 33-40*a*. Such high loads experienced by the leading cutter element of a set of redundant cutter elements may increase the likelihood of premature damage or breakage to such leading cutter element. Consequently, it may be desirable to provide structural feature(s) to reduce the likelihood of premature damage or breakage of such leading cutter elements in a set of redundant cutter elements. In the embodiment shown in FIGS. 1-5, integral depth-of-cut limiter 56 is provided to limit the DOC of leading redundant cutter element 31-40*a*, and thereby protecting leading redundant cutter element 31-40*a*. However, other structures and features may be provided in addition to, or as an alternative, to an integral depth-of-cut limiter (e.g., integral depth-of-cut limiter 56) to protect a leading redundant cutter element (e.g., leading redundant cutter element 31-40*a*). For example, referring now to FIG. 6, a top schematic view of an embodiment of a drag bit 10' in accordance with the principles described herein is shown. Bit 10' is substantially the same as bit 10 previously described, except that bit 10' includes a depth-of-cut limiter insert 55 with a dome-shaped end 55*a* as previously described to protect leading redundant cutter element 31-40*a*. In this embodiment, no integral depth-of-cut limiter is provided. Specifically, depth-of-cut limiter 55 is positioned behind and at the same radial position as redundant leading cutter element 31-40*a*. Similar to integral depth-of-cut limiter 56, depth-of-cut limiter insert 55 is intended to slide across the formation and limit the DOC and associated cutting forces experienced by leading redundant cutter element 31-40*a*, thereby reducing the likelihood of premature damage or breakage to leading redundant cutter element 31-40*a*. Similar to integral depth-of-cut limiter 56, depth-of-cut limiter insert 55 associated with cutter element 31-40*a* preferably has an extension height and offset distance similar to integral depth-of-cut limiter 56 described with reference to FIG. 5.

Figure 7A:
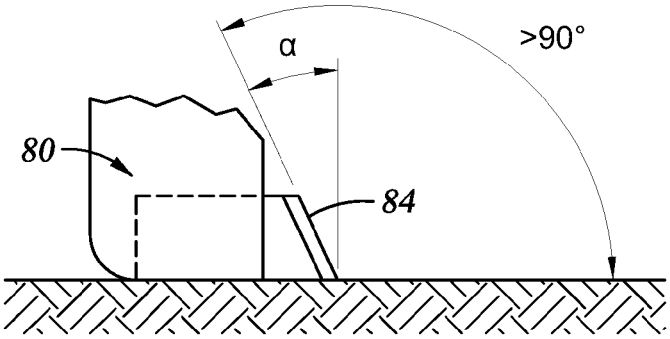
FIGS. 7*a-c* are schematic side views illustrating exemplary cutter elements engaging the formation at various degrees of backrake.
Figure 7B:
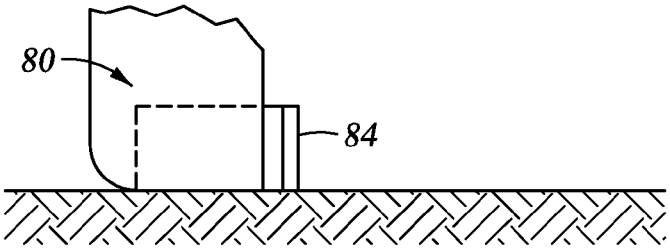
Figure 7C:
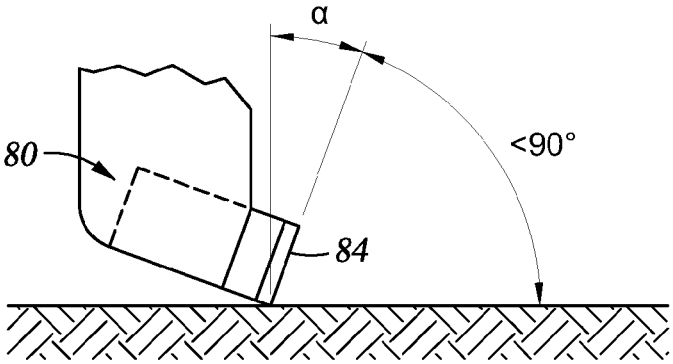

The orientation and geometry of the cutting face of a leading redundant cutter element may also be configured to protect and enhance the durability of a leading redundant cutter element. Referring momentarily to FIGS. 7*a-c*, three cutter elements 80 having cutting faces 84 are shown mounted on a bit with different backrake angles. In general, cutter elements 80 may be primary cutter elements or backup cutter elements. The backrake angle of a cutting face may generally be defined as the angle α formed between cutting face 84 of the cutter element 80 and a line that is normal to the formation material being cut. As shown in FIG. 7*b*, with a cutting face having zero backrake angle α, the cutting face 84 is substantially perpendicular or normal to the formation material. As shown in FIG. 7*a*, a cutter element having a negative backrake angle α has a cutting face 84 that engages the formation material at an angle that is greater than 90° measured from the formation material. As shown in FIG. 7*c*, a cutter element 80 having a positive backrake angle α has a cutting face 84 that engages the formation material at an angle that is less than 90° measured from the formation material.

In general, the greater the backrake angle, the less aggressive the cutter element and the lower the cutting loads experienced by the cutter element. Where the cutting faces of two cutter elements each have a negative backrake angle α, the cutter element with the more negative backrake angle α is more aggressive. Where the cutting faces of both cutter elements each have a positive backrake angle α, the cutter element with the larger backrake angle α is less aggressive. Further, where the cutting face of one cutter element has a negative backrake angle α and the cutting face of the other cutter element has a positive backrake angle α, the cutter element with the positive backrake angle α is less aggressive. For example, all other factors being equal, cutter element 84 in FIG. 7*a* experiences greater cutting forces than cutter element 84 in FIG. 7*b*, and cutter element 7*b* in FIG. 7*b* experiences greater cutting forces than cutter element 84 in FIG. 7*c*. In the embodiment of bit 10 shown and described with reference to FIGS. 1-5, primary cutting faces 44 preferably have a positive backrake angle α between 5° and 45°, and more preferably between 10° and 30°. To provide some additional protection to leading redundant cutter element 31-40*a*, cutting face 31-44*a* preferably has a positive backrake angle α of about 5° to 10° more than the backrake angle of cutting face 33-44*a* of trailing redundant cutter element 33-40*a*.

Figure 8A:
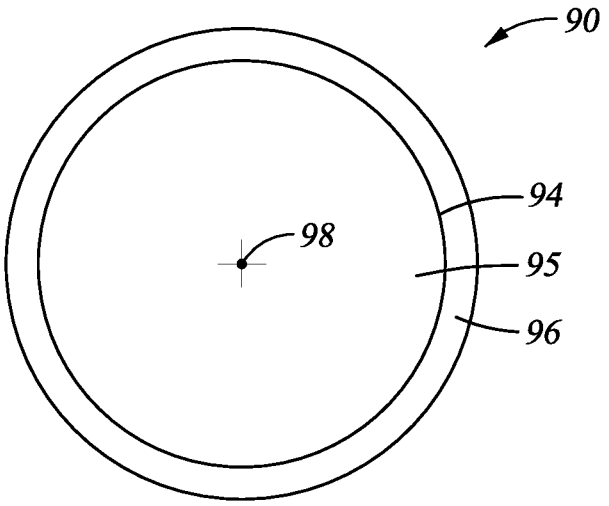
FIGS. 8*a* and *b* are end and side views, respectively, of an exemplary beveled cutter element.
Figure 8B:
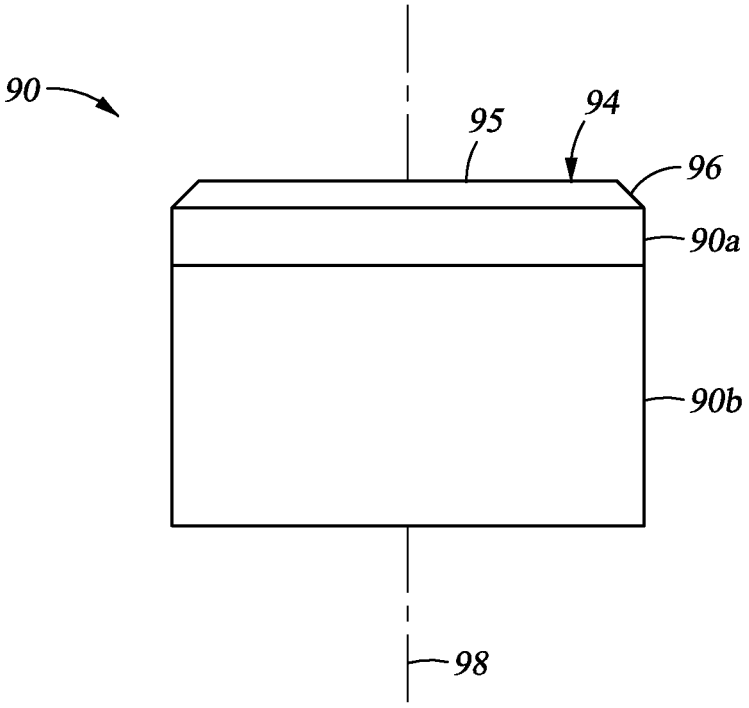

Referring briefly to FIGS. 8*a* and 8*b*, a beveled or chamfered cutter element 90 having a cutting face 94 including a bevel or chamfer 96 is shown. In general, beveled cutter element 90 may be primary cutter element or backup cutter element. Beveled cutter element 90 includes a PDC table 90*a* forming cutting face 94 supported by a carbide substrate 90*b*. The interface between PDC table 90*a* and substrate 90*b* may be planar or non-planar, according to many varying designs for same as known in the art. Cutting face 94 is to be oriented on a bit facing generally in the direction of bit rotation. The central portion 95 of cutting face 94 is planar in this embodiment, although concave, convex, or ridged surfaces may be employed. Bevel or chamfer 96 extends from the periphery of central portion 95 to cutting edge at the sidewall of PDC table 90*a*. Bevel 96 and the cutting edge may extend about the entire periphery of table, or along only a periphery portion to be located adjacent the formation to be cut. Further, the size and angular orientation of bevel 96 may vary about the circumferential periphery of cutting face 94 as described in U.S. patent application Ser. No. 11/117,648, entitled "Cutter Having Shaped Working Surface with Varying Edge Chamfer" and filed Apr. 28, 2005, which is hereby incorporated herein by reference in its entirety.

The angle β of bevel 96 measured relative to the central axis 98 of cutter element 90 and the size or width of bevel 96 measured radially relative to axis 98 may vary. In general, a larger bevel enhances cutter durability, by improving impact resistance. In the embodiment of bit 10 shown and described with reference to FIGS. 1-5, primary cutting faces 44 may include a bevel. To provide some additional protection to leading redundant cutter element 31-40*a*, it preferably includes a bevel. In embodiments, where trailing redundant cutter element 33-40*a*, leading redundant cutter element 31-40*a* preferably has a larger bevel than trailing redundant cutter element 33-40*a*. In particular, leading redundant cutter element 31-40*a* preferably has a bevel size 5% to 50% larger than the bevel size of trailing redundant cutter element 33-40*a*.

Although protective features and structures (e.g., integral depth-of-cut limiter 56, depth-of-cut limiter insert 55, decreased backrake angles, increased bevel size, etc.) have been described with reference to the leading redundant cutter element in the cone region (e.g., leading redundant cutter element 31-40*a* in cone region 24), in general, such protective features and structures may be employed in association with any cutter element, including redundant cutter elements in the shoulder or gage regions (e.g., regions 25, 26).

Figure 9:
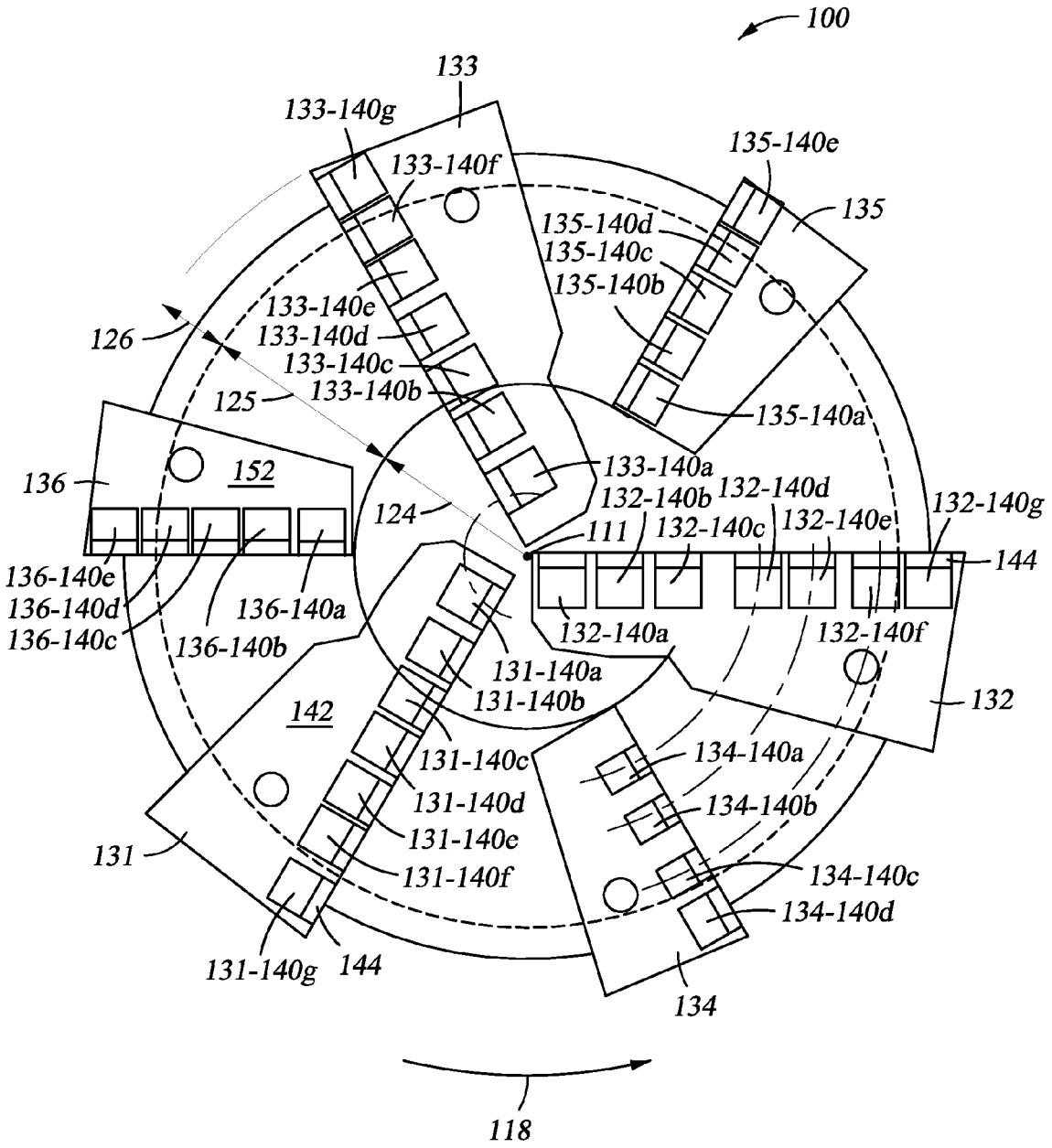
FIG. 9 is a schematic top view of an embodiment of a bit made in accordance with the principles described herein.

Referring now to FIG. 9, a schematic top view of another embodiment of a bit 100 is shown. Bit 100 is substantially the same as bit 10 previously described. Namely, bit 100 includes a bit axis 111, a cutting direction of rotation 118, and a bit face 120 generally divided into a radially inner cone region 124, a radially outer gage region 126, and a shoulder region 125 radially disposed between cone region 124 and gage region 126. In addition, bit 100 includes three primary blades 131, 132, 133 extending radially along bit face 120 from within cone region 124 proximal bit axis 111 to gage region 126, and three secondary blades 134, 135, 136 extending radially along bit face 120 from shoulder region 125 proximal cone region 124 to gage region 126. However, in this embodiment, the radially inner ends of secondary blades 134, 135, 136 define the radial boundary of cone region 124.

Primary blades 131, 132, 133 and secondary blades 134, 135, 136 provide cutter-supporting surfaces 142, 152, respectively, for mounting a plurality of primary cutter elements 140, each having a forward-facing primary cutting face 144. In this embodiment, a row of seven primary cutter elements 140 is provided on each primary blade 131, 132, 133. Further, a row of four primary cutter elements 140 is provided on secondary blade 134, and a row of five primary cutter elements 140 is provided on each secondary blade 135, 136. Still further, cutter-supporting surfaces 142, 152 also support a plurality of depth-of-cut limiter inserts 155—one depth-of-cut limiter insert 155 is provided on each blade 131-136 in shoulder region 125.

For purposes of clarity and further explanation, primary cutter elements 140 mounted to primary blades 131, 132, 133 are assigned reference numerals 131-140*a-g*, 132-140*a-g*, 133-140*a-g*, respectively. Likewise, primary cutter elements 140 mounted to secondary blades 134, 135, 136 are assigned reference numerals 134-140*a-d*, 135-140*a-e*, 136-140*a-e*, respectively.

Referring still to FIG. 9, in this embodiment, a total of seven cutter elements are disposed in cone region 124—primary cutter elements 131-140*a, b*, 132-140*a-c*, 133-140*a, b*. Further, in this embodiment, a total of two cutter elements in cone region 124 are redundant with one or more other cutter elements in cone region 124—primary cutter elements 131-140*a*, 133-140*a* are redundant with each other, while remaining primary cutter elements 131-140*b*, 132-140*a-c*, 133-140*b* in cone region 124 are disposed at unique radial positions. Thus, in this embodiment, the total cutter redundancy percentage in cone region 124 is about 29% (two total redundant cutter elements in cone region 124 divided by a total of nine cutter elements in cone region 124). Likewise, the primary blade cutter redundancy percentage in cone region 124 is 29% (two total redundant cutter elements on primary blades in cone region 124 divided by a total of nine cutter elements on primary blades in cone region 124).

Moving now to shoulder region 125, in this embodiment, a total of twenty-two cutter elements are disposed in shoulder region 125—primary cutter elements 131-140*c-f*, 132-140*d-f*, 133-140*c-f*, 134-140*a-c*, 135-140*a-d*, 136-140*a-d*. Further, in this embodiment, a total of six cutter elements in shoulder region 125 are redundant with one or more other cutter elements in shoulder region 125—primary cutter elements 132-140*d*, 134-140*a* are redundant with each other, primary cutter elements 132-140*e*, 134-140*b* are redundant with each other, and 132-140*f*, 134-140*c* are redundant with each other. Remaining primary cutter elements 131-140*c-f*, 133-140*c-f*, 135-140*a-d*, 136-140*a-d* in shoulder region 124 are disposed at unique radial positions. Thus, in this embodiment, the total cutter redundancy percentage in shoulder region 125 is about 27% (six total redundant cutter elements in shoulder region 125 divided by twenty-two total cutter elements in shoulder region 125), which is less than the total cutter redundancy percentage in cone region 124 previously described. In addition, the primary blade cutter redundancy percentage in shoulder region 125 is also about 27% (three total redundant cutter elements on primary blades in shoulder region 125 divided by eleven total cutter elements on primary blades in shoulder region 125), which is also less than the primary blade cutter redundancy percentage in cone region 124 previously described.

Moving now to gage region 126, in this embodiment, a total of six cutter elements are disposed in gage region 126—primary cutter elements 131-140*g*, 132-140*g*, 133-140*g*, 134-140*d*, 135-140*e*, 136-140*e*. Further, in this embodiment, no cutter elements in gage region 126 are redundant with one or more other cutter elements on bit 100. Rather, each cutter element in gage region 126 is disposed in a unique radial position. Thus, in this embodiment, the total cutter redundancy percentage in gage region 126 is 0% (zero total redundant cutter elements in gage region 126 divided by six total cutter elements in gage region 126), which is less than the total cutter redundancy percentage in regions 124, 125 previously described. In addition, the primary blade cutter redundancy percentage in gage region 126 is also about 0% (zero total redundant cutter elements on primary blades in gage region 126 divided by three total cutter elements on primary blades in gage region 126 on primary blades), which is also less than the primary blade cutter redundancy percentage in regions 124, 125 previously described.

Referring still to FIG. 9, in this embodiment, each primary blade 131, 132, 133 includes at least one redundant cutter element. Namely, primary cutter elements 131-140*a*, 132-140*d-f*, 133-140*a* are each redundant with at least one other cutter element on bit 100. In addition, secondary blade 134 includes at least one redundant cutter element. Namely, primary cutter elements 134-140*a-c* are redundant with at least one other cutter element on bit 100. However, secondary blades 135, 136 include no redundant cutter elements, and therefore, may be described as single set blades.

Each depth-of-cut limiter insert 155 is disposed at the same radial position as a primary cutter element 140 on the same blade. More specifically, depth-of-cut limiter insert 155 on primary blade 131 is disposed at the same radial position as primary cutter element 131-140*f*, depth-of-cut limiter insert 155 on primary blade 132 is disposed at the same radial position as primary cutter element 132-140*f*, depth-of-cut limiter insert 155 on primary blade 133 is disposed at the same radial position as primary cutter element 133-140*f*, depth-of-cut limiter insert 155 on secondary blade 134 is disposed at the same radial position as primary cutter element 134-140*c*; depth-of-cut limiter insert 155 on secondary blade 135 is disposed at the same radial position as primary cutter element 135-140*d*; and depth-of-cut limiter insert 155 on secondary blade 136 is disposed at the same radial position as primary cutter element 136-140*d*.

Figure 10:
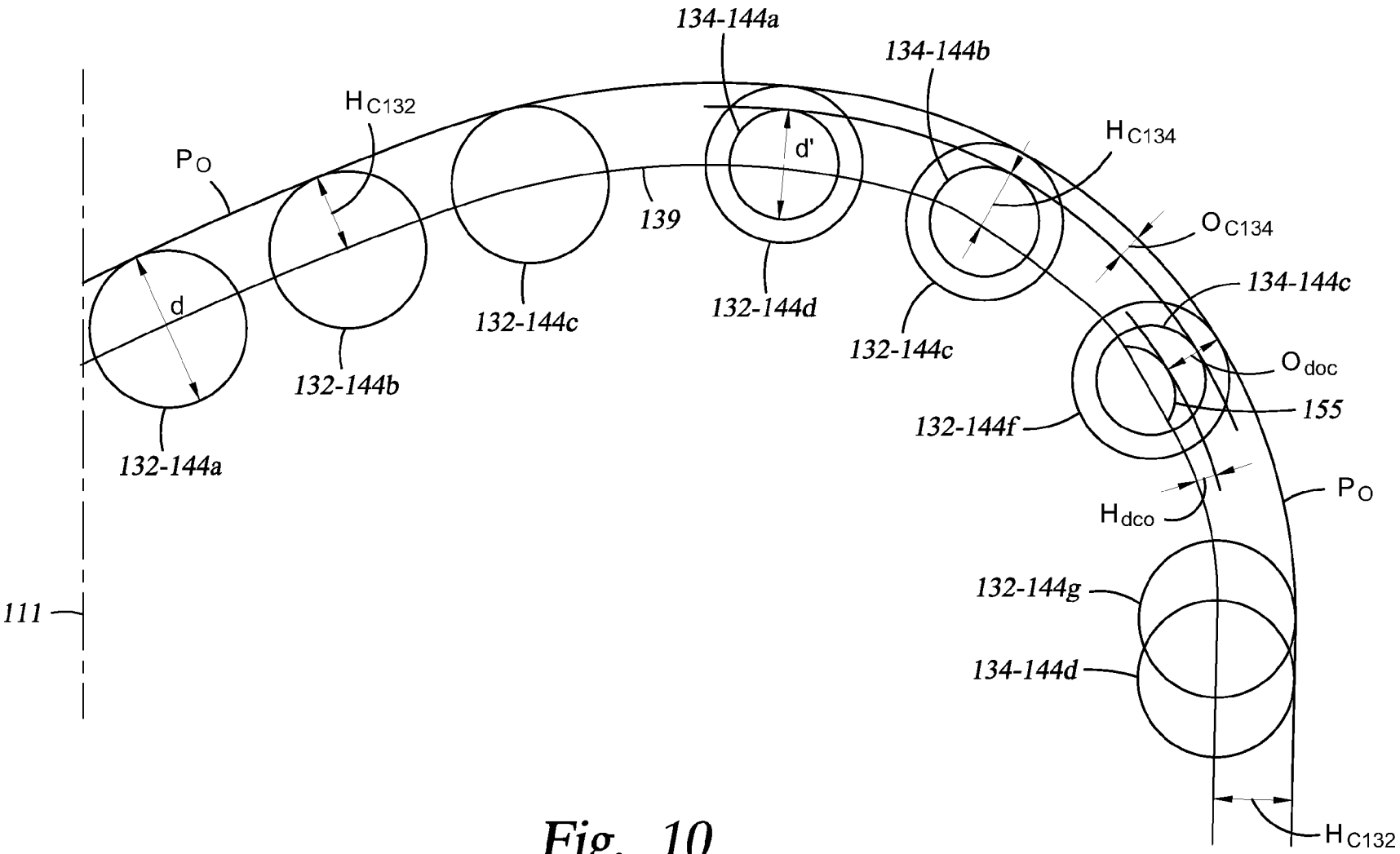
FIG. 10 is an enlarged rotated profile view of the blades and select cutting faces of the bit shown in FIG. 9.

Referring now to FIG. 10, the profiles of primary blades 131, 132, 133, secondary blades 134, 135, 136, primary cutting faces 144 mounted to blades 132, 134, and depth-of-cut limiter inserts 155 mounted to blades 132, 134 are schematically shown rotated into a single rotated profile view. For purposes of clarity, primary cutting faces 144 and depth-of-cut limiter inserts 155 mounted to blades 131, 133, 135, 136 are not shown in this view. Primary cutting faces 144 of primary cutter elements 132-140*a-g*, 134-140*a-d* are assigned reference numerals 132-144*a-g*, 134-144*a-d*, respectively.

In rotated profile view, each primary blade 131, 132, 133 and each secondary blades 134, 135, 136 forms a blade profile generally defined by its cutter-supporting surface 142, 152. In this embodiment, the blade profiles of each primary blade 131, 132, 133 and each secondary blade 134, 135, 136 are generally coincident with each other, thereby forming a single composite blade profile 139.

Each primary cutting face 132-144*a-g* extends to substantially the same extension height $H_{c132}$, and define the outermost cutting profile $P_o$ of bit 100. Primary cutting faces 144 of blades 131, 133, 135, 136 (not shown in FIG. 10) are each on profile in this embodiment. However, unlike bit 10 previously described, select cutting faces 144 on bit 100 are "off profile" or offset from outermost cutting profile $P_o$. In particular, cutting faces 134-144*a-c* each have an extension height $H_{c134}$ that is less than extension height $H_{c132}$; cutting faces 134-144*a-c* are offset from the outermost cutting profile $P_o$ by an offset distance $O_{c134}$ equal to extension height $H_{c132}$ minus extension height $H_{c134}$. Offset $O_{c134}$ is preferably less than 0.100 in. (~2.54 mm), and more preferably between 0.040 in. (~1.02 mm) and 0.060 in. (~1.52 mm).

The amount or degree of offset of cutting faces 134-144*a-c* relative to outermost cutting profile $P_o$ may also be expressed in terms of an offset ratio. As used herein, the phrase "offset ratio" may be used to refer to the ratio of the offset distance of a cutting face from the outermost cutting profile to the diameter of the cutting face. The offset ratio of cutting faces 134-144*a-c* is preferably between 0.030 and 0.25.

As previously described, in this embodiment, each primary cutting face 132-144*a-g* has substantially the same extension height $H_{c132}$, and each primary cutting face 134-144*a-c* has substantially the same extension height $H_{c134}$ that is less than extension height $H_{c132}$, resulting in a uniform offset distance $O_{c134}$. However, in other embodiments, the offset distance between different cutting faces in rotated profile view may be non-uniform.

Referring still to FIG. 10, each depth-of-cut limiter insert 155 extends to substantially the same extension height $H_{doc}$. Extension height $H_{doc}$ is less than the extension height $H_{c132}$, and also less than extension height $H_{c134}$. In particular, depth-of-cut limiter inserts 155 are offset from outermost cutting profile PO by an offset distance $O_{doc}$. Offset distance $O_{doc}$ of depth-of-cut limiter inserts 155 is preferably between 0.050 in. (~1.27 mm) and 0.150 in. (~3.81 mm), and more preferably between 0.060 in. (~1.524 mm) and 0.080 in. (~2.032 mm).

Referring again to FIGS. 9 and 10, similar to cutter elements 40 previously described, each primary cutting element 140 of bit 100 comprises an elongated and generally cylindrical support member or substrate and a disk-shaped cutting face 144 bonded to the exposed end of the support member. However, unlike primary cutter elements 40 previously described, primary cutter elements 140 shown in FIGS. 9 and 10 have different sizes. As best shown in FIG. 9, primary cutting faces 134-144*a-c* have a diameter d' that is less than the diameter d of the other cutting faces 144. For an exemplary bit 100 having an overall gage diameter of 7.875 in. (~20 cm), diameter d is about 0.625 in. (~16 mm) and diameter d' is about 0.512 in. (~13 mm).

Referring specifically to FIG. 10, as a result of their relative sizes and radial position, primary cutting faces 132-144*d*, 134-144*a*, primary cutting faces 132-144*e*, 134-144*b*, primary cutting faces 132-144*f*, 134-144*c*, respectively, completely eclipse or overlap each other in rotated profile view. Likewise, cutting faces 144 of primary cutter elements 131-140*a*, 133-140*a* (not shown in FIG. 9) completely eclipse or overlap each other in rotated profile view. However, all the other primary cutter elements 140 are sized and positioned in differing radial positions to enhance bottomhole coverage.

Figure 11:
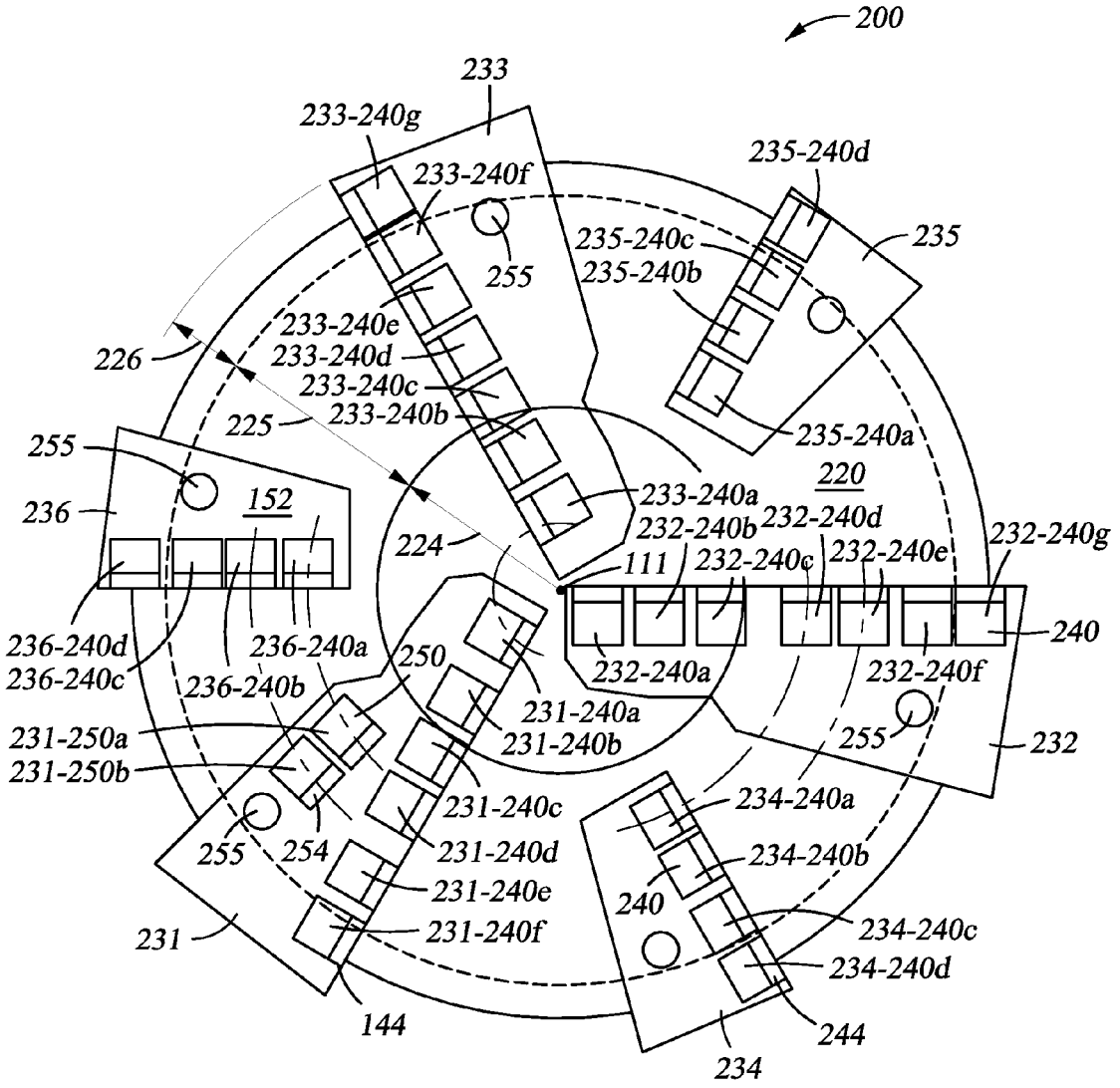
FIG. 11 is a schematic top view of an embodiment of a bit made in accordance with the principles described herein.

Referring now to FIG. 11, a schematic top view of another embodiment of a bit 200 is illustrated. Bit 200 is similar to bit 10 previously described. Namely, bit 200 includes a bit axis 211, a cutting direction of rotation 218, and a bit face 220 generally divided into a radially inner cone region 224, a radially outer gage region 226, and a shoulder region 225 radially disposed between cone region 224 and gage region 226. In addition, bit 200 includes three primary blades 231, 232, 233 extending radially along bit face 220 from within cone region 224 proximal bit axis 211 to gage region 226, and three secondary blades 234, 235, 236 extending radially along bit face 220 from shoulder region 225 proximal cone region 224 to gage region 226.

Primary blades 231, 232, 233 and secondary blades 234, 235, 236 provide cutter-supporting surfaces 242, 252, respectively, for mounting a plurality of primary cutter elements 240, each having a forward-facing primary cutting face 244. In this embodiment, a row of six primary cutter elements 240 is provided on primary blade 231, and a row of seven primary cutter elements 240 is provided on each primary blade 232, 233. Further, a row of four primary cutter elements 240 is provided on each secondary blade 234, 235, 236. Cutter-supporting surfaces 242, 252 also support a plurality of depth-of-cut limiter inserts 255—one depth-of-cut limiter insert 255 is provided on each blade 231-236 in shoulder region 225 proximal gage region 226. However, unlike bits 10 and 100 previously described, in this embodiment, a plurality of backup cutter elements 250, each having a backup cutting face 254, are provided. In particular, backup cutter elements 250 are mounted to primary blade 231. Backup cutter elements 250 are positioned adjacent one another generally in a second or trailing row extending radially along primary blade 231.

Backup cutter elements 250 are positioned rearward of primary cutter elements 240 on primary blade 231. Thus, when bit 200 rotates about central axis 211 in the cutting direction represented by arrow 218, primary cutter elements 240 on primary blade 231 lead or precede each backup cutter element 250 provided on primary blade 231. Thus, as used herein, the term "backup cutter element" may be used to refer to a cutter element that trails another cutter element disposed on the same blade when the bit (e.g., bit 200) is rotated in the cutting direction. Although backup cutter elements 250 are shown as being arranged in a row on one primary blade 231, backup cutter elements 250 may be mounted in other suitable arrangements. Further, in other embodiments, one or more backup cutter elements (e.g., backup cutter elements) may be provided on other primary blades (e.g., primary blades 232, 233), secondary blades (e.g., secondary blades 234, 235, 236), tertiary blades, or combinations thereof.

It should be appreciated that additional circumferential space is required on the cutter-supporting surface of a blade (e.g., primary blade, secondary blade, etc.) to accommodate backup cutter elements (e.g., backup cutter elements 250). Consequently, blades including backup cutter elements may be circumferentially wider than blades not including backup cutter elements. In addition, as compared to relatively shorter secondary blades (e.g., secondary blades 234, 235, 236), the positioning of backup cutter elements (e.g., backup cutter elements 250) on a relatively longer primary blade (e.g., primary blade 231) allows for a greater degree of freedom in choosing the radial location of each backup cutter element. For instance, one or more backup cutter elements may be positioned on the cutter-supporting surface of a primary blade in the cone region, the shoulder region, the gage region, or combinations thereof.

Each primary cutter element 240 and each backup cutter element 250 comprises an elongated and generally cylindrical support member or substrate which is received and secured in a pocket formed in the surface of the blade to which it is fixed. Cutting faces 244, 254 each comprise a disk or tablet-shaped, hard cutting layer of polycrystalline diamond or other superabrasive material is bonded to the exposed end of the support member. In this embodiment, each cutting element 240, 250 has substantially the same geometry and size. However, in other embodiments, the backup cutting elements (e.g., backup cutting elements 250) may have a different size than the primary cutting elements (e.g., primary cutting elements 240).

For purposes of clarity and further explanation, primary cutter elements 240 mounted to primary blades 231, 232, 233 are assigned reference numerals 231-240*a-f*, 232-240*a-g*, 233-240*a-g*, respectively; primary cutter elements 240 mounted to secondary blades 234, 235, 236 are assigned reference numerals 234-240*a-d*, 235-240*a-d*, 236-240*a-d*, respectively; and backup cutter elements 250 mounted to primary blade 231 are assigned reference numerals 231-250*a, b*.

Referring still to FIG. 11, the row of backup cutter elements 231-250*a, b* is positioned behind, and trails, the row of primary cutter elements 231-240*a-f* provided on the same primary blade 231. However, in this embodiment, each backup cutter elements 231-250*a, b* is disposed at a radial position different than primary cutter elements 231-240*a-f* on the same primary blade 231. Further, in this embodiment, each backup cutter element 231-250*a, b* is redundant with an associated primary cutter element 236-240*a, b*, respectively, provided on secondary blade 236. In other embodiments, one or more backup cutter elements (e.g., backup cutter element 231-250*a*) may be redundant with an associated primary cutter element on the same blade (e.g., primary cutter elements 231-240*c*).

A total of seven cutter elements are disposed in cone region 224—primary cutter elements 231-240*a , b*, 232-240*a-c*, 233-240*a, b*. Further, in this embodiment, a total of two cutter elements in cone region 224 are redundant with one or more other cutter elements in cone region 224—primary cutter elements 231-240*a*, 233-240*a* are redundant with each other, while remaining primary cutter elements 231-240*b*, 232-240*a-c*, 233-240*b* in cone region 224 are disposed at unique radial positions. Thus, in this embodiment, the total cutter redundancy percentage in cone region 224 is about 29% (two total redundant cutter elements in cone region 224 divided by seven total cutter elements in cone region 224), and the primary blade cutter redundancy percentage in cone region 224 is also 29% (two total redundant cutter elements on primary blades in cone region 224 divided by seven total cutter elements on primary blades in cone region 224.

Moving now to shoulder region 225, in this embodiment, a total of twenty-one cutter elements are disposed in shoulder region 225—primary cutter elements 231-240*c-e*, 232-240*d-f*, 233-240*c-f*, 234-240*a-c*, 235-240*a-c*, 236-240*a-c* and backup cutter elements 236-250*a, b*. Further, in this embodiment, a total of four cutter elements in shoulder region 225 are redundant with one or more other cutter elements in shoulder region 225—primary cutter element 236-240*a* is redundant with backup cutter element 231-250*a*, and primary cutter element 236-240*b* is redundant with backup cutter element 231-250*b*. Remaining primary cutter elements 231-240*c-e*, 232-240*d-f*, 233-240*c-f*, 234-240*a-c*, 235-2401-*c*, 236-240*a-c* in shoulder region 224 are disposed at unique radial positions. Thus, in this embodiment, the total cutter redundancy percentage in shoulder region 225 is about 19% (four total redundant cutter elements in shoulder region 225 divided by twenty-one total cutter elements in shoulder region 225), which is less than the total cutter redundancy percentage in cone region 224 previously described. In addition, the primary blade cutter redundancy percentage in shoulder region 225 is also about 17% (two total redundant cutter elements on primary blades in shoulder region 225 divided by twelve total cutter elements on primary blades in shoulder region 225), which is also less than the primary blade cutter redundancy percentage in cone region 224 previously described.

Moving now to gage region 226, in this embodiment, a total of six cutter elements are disposed in gage region 226—primary cutter elements 231-240*f*, 232-240*g*, 233-240*g*, 234-240*d*, 235-240*d*, 236-240*d*. Further, in this embodiment, no cutter elements in gage region 226 are redundant with one or more other cutter elements in gage region 226. Rather, each cutter element in gage region 226 is disposed in a unique radial position. Thus, in this embodiment, the total cutter redundancy percentage in gage region 226 is 0% (zero total redundant cutter elements in gage region 226 divided by six total cutter elements in gage region 226), which is less than the total cutter redundancy percentage in cone region 224 and shoulder region 225 previously described. In addition, the primary blade cutter redundancy percentage in gage region 226 is also about 0% (zero total redundant cutter elements on primary blades in gage region 226 divided by three total cutter elements on primary blades in gage region 226), which is also less than the primary blade cutter redundancy percentage in cone region 224 and shoulder region 225 previously described.

Referring still to FIG. 11, in this embodiment, each primary blade 231, 233 includes at least one redundant cutter element. Namely, primary cutter elements 231-240*a*, 232-233*a* and backup cutter elements 231-250*a, b* are each redundant with at least one other cutter element on bit 200. In addition, secondary blade 236 includes at least one redundant cutter element. Namely, primary cutter elements 236-240*a, b* are redundant with at least one other cutter element on bit 200. However, primary blade 232 and secondary blades 234, 235 include no redundant cutter elements, and therefore, may be described as single set blades.

Each depth-of-cut limiter insert 255 is disposed at the same radial position as a primary cutter element 240 on the same blade. More specifically, depth-of-cut limiter insert 255 on primary blade 231 is disposed at the same radial position as primary cutter element 231-240*f*; depth-of-cut limiter insert 255 on primary blade 232 is disposed at the same radial position as primary cutter element 232-240*f*; depth-of-cut limiter insert 255 on primary blade 233 is disposed at the same radial position as primary cutter element 233-240*f*; depth-of-cut limiter insert 255 on secondary blade 234 is disposed at the same radial position as primary cutter element 234-240*c*; depth-of-cut limiter insert 255 on secondary blade 235 is disposed at the same radial position as primary cutter element 235-240*c*; and depth-of-cut limiter insert 255 on secondary blade 236 is disposed at the same radial position as primary cutter element 236-140*c*.

Figure 12:
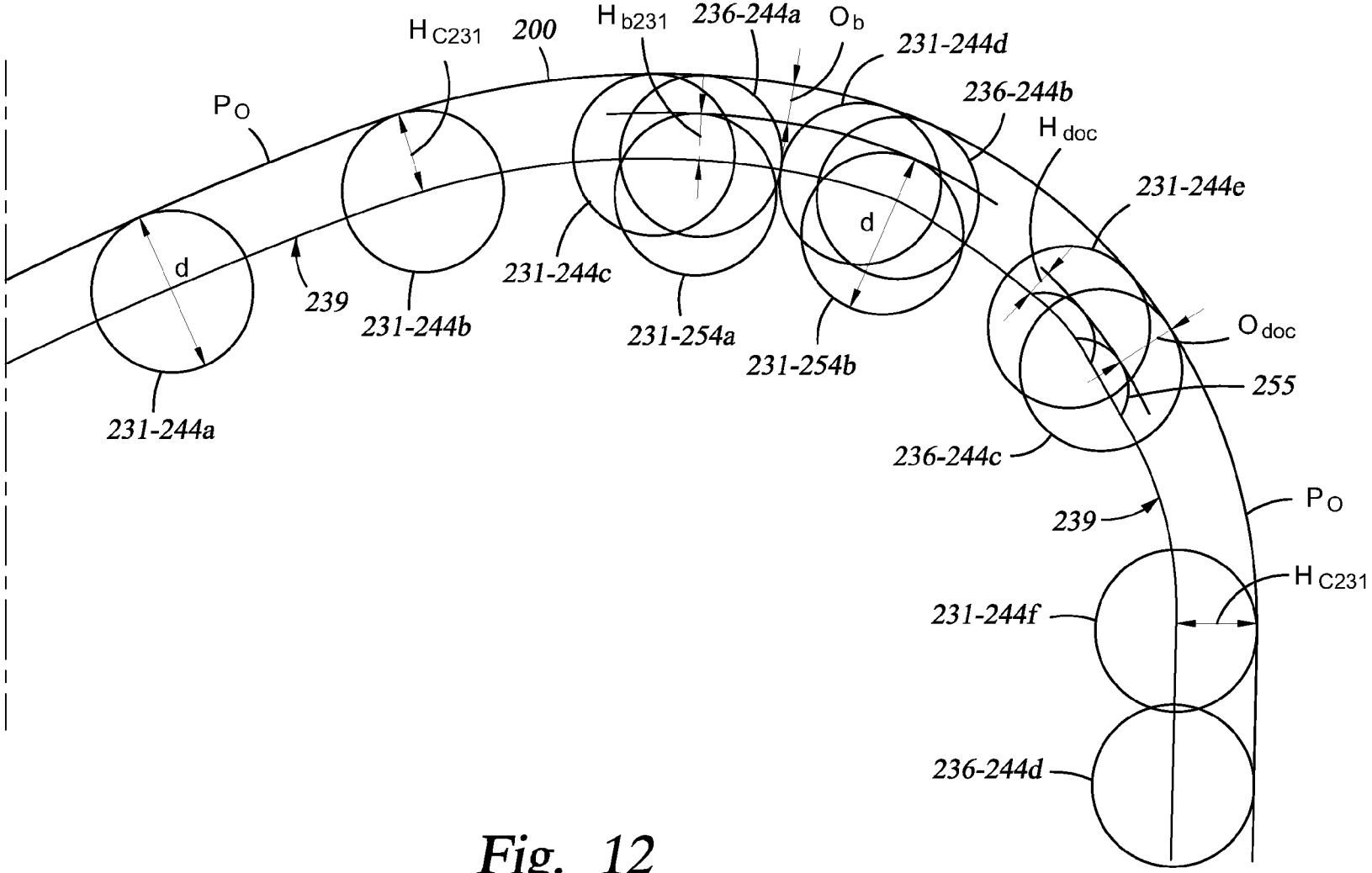
FIG. 12 is an enlarged rotated profile view of the blades and select cutting faces of the bit shown in FIG. 11.

Referring now to FIG. 12, the profiles of primary blades 231, 232, 233, secondary blades 234, 235, 236, cutting faces 244 mounted to blade 231, 236, cutting faces 254 mounted to blade 231, and depth-of-cut limiter inserts 255 mounted to blades 231, 236 are shown rotated into a single rotated profile view. For purposes of clarity, primary cutting faces 244 and depth-of-cut limiter inserts 255 mounted to blades 232, 233, 234, 235 are not shown in this view. Primary cutting faces 244 of primary cutter elements 231-240*a-f*, 236-240*a-d* are assigned reference numerals 231-244*a-f*, 236-244*a-d*, respectively, and backup cutting faces 254 of backup cutter elements 236-250*a, b* are assigned reference numerals 236-254*a, b*, respectively.

In rotated profile view, each primary blade 231, 232, 233 and each secondary blade 234, 235, 236 forms a blade profile generally defined by its cutter-supporting surface 242, 252. In this embodiment, the blade profiles of blades 231-236 are substantially coincident with each other, thereby forming a single composite blade profile 239.

Each primary cutting face 231-244*a-f* extends to an extension height $H_{c231}$, and defines the outermost cutting profile $P_o$ of bit 200. Each primary cutting face 236-244*a-d* also extends to extension height $H_{c231}$ and outermost cutting profile $P_o$, and are therefore, "on profile". Each primary cutting faces 244 on blades 232, 233, 234, 235 (not shown in FIG. 9) is "on profile" in this embodiment. However, each backup cutting face 231-254*a, b* extends to an extension height $H_{b231}$ that is less than extension height $H_{c231}$. Thus, backup cutting faces 231-254*a, b* may be described as being off profile, or offset from the outermost cutting profile $P_o$ by an offset distance $O_b$. Offset distance $O_b$ is preferably between 0.040 in. and 0.150 in.

Referring still to FIG. 12, each depth-of-cut limiter insert 255 extends to substantially the same extension height $H_{doc}$. Extension height $H_{doc}$ is less than the extension heights $H_{c231}$ and extension height $H_{b231}$. In particular, depth-of-cut limiter inserts 255 are offset from outermost cutting profile $P_o$ by an offset distance $O_{doc}$ preferably between 0.050 in. and 0.150 in.

Referring now to FIGS. 11 and 12, each cutting element 240, 250 comprises an elongated and generally cylindrical support member or substrate and a disk-shaped forward-facing cutting face 244, 254, respectively, bonded to the exposed end of the support member. In this embodiment, each cutter element 240, 250 has substantially the same size and geometry. As best shown in FIG. 12, each cutting face 244, 254 has substantially the same diameter d.

Referring specifically to FIG. 12, as a result of their relative sizes and radial position, primary cutting faces 236-244*a, b* substantially eclipse or overlap with backup cutting faces 231-254*a, b*, respectively, in rotated profile view. Remaining cutting faces 244 are sized and positioned in differing radial positions to enhance bottomhole coverage.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A drill bit for drilling a borehole in earthen formations, the bit comprising:

a bit body having a bit axis and a bit face including a cone region, a shoulder region, and a gage region;

a first primary blade extending radially along the bit face from the cone region to the gage region;

a plurality of primary cutter elements mounted to the first primary blade, each primary cutter element on the first primary blade being mounted in a different radial position;

a second primary blade extending radially along the bit face from the cone region to the gage region;

a plurality of primary cutter elements mounted to the second primary blade, each primary cutter element on the second primary blade being mounted in a different radial position;

wherein a first primary cutter element of the plurality of primary cutter elements on the first primary blade and a first primary cutter element of the plurality of primary cutter elements on the second primary blade are each positioned in the cone region;

wherein the first primary cutter element on the first primary blade is redundant with the first primary cutter element on the second primary blade;

wherein the cone region has a total cutter redundancy percentage; and wherein the shoulder region has a total cutter redundancy percentage that is less than the total cutter redundancy percentage in the cone region.

2. The drill bit of claim 1 wherein the gage region has a total cutter redundancy percentage that is less than the total cutter redundancy percentage in the cone region.

3. The drill bit of claim 2 wherein the total cutter redundancy percentage of the gage region is zero.

4. The drill bit of claim 1 wherein the total cutter redundancy percentage of the cone region is greater than 25%.

5. The drill bit of claim 1 wherein the first primary cutter element on the first primary blade is the only redundant primary cutter element on the first primary blade and the first primary cutter element on the second primary blade is the only redundant primary cutter primary on the second primary blade.

6. The drill bit of claim 1 further comprising:

a third primary blade extending radially along the bit face from the cone region through the shoulder region to the gage region;

a plurality of primary cutter elements mounted to the third primary blade, each primary cutter element on the third primary blade being mounted in a different radial position.

a first secondary blade extending along the bit face from the shoulder region to the gage region;

a plurality of primary cutter elements mounted to the first secondary blade, each primary cutter element on the first secondary blade being mounted in different radial position;

wherein a first primary cutter element of the plurality of primary cutter elements on the third primary blade and a first primary cutter element of the plurality of primary cutter elements on the first secondary blade are each positioned in the shoulder region;

wherein the first primary cutter element on the third primary blade is redundant with the first primary cutter element on the first secondary blade.

7. The drill bit of claim 6 wherein the gage region has a total cutter redundancy percentage that is less than the total cutter redundancy percentage in the shoulder region.

8. The drill bit of claim 7 wherein a second primary cutter element of the plurality of primary cutter elements on the third primary blade and a second primary cutter element of the plurality of primary cutter elements on the first secondary blade are each positioned in the shoulder region;

wherein the second primary cutter element on the third primary blade is redundant with the second primary cutter element on the first secondary blade.

9. The drill bit of claim 8 further comprising:

a second secondary blade extending along the bit face from the shoulder region to the gage region;

a plurality of primary cutter elements mounted to the second secondary blade, each primary cutter element on the second secondary blade being mounted in a unique radial position.

10. The drill bit of claim 9 wherein the first secondary blade is circumferentially disposed between the first primary blade and the third primary blade and the second secondary blade is circumferentially disposed between the third primary blade and the second primary blade.

11. The drill bit of claim 6 wherein the total cutter redundancy percentage in the shoulder region is greater than 0 and less than 25%.

12. The drill bit of claim 11 wherein the total cutter redundancy percentage in the gage region is zero.

13. The drill bit of claim 6 wherein each primary cutter element has a primary cutting face with a diameter in rotated profile view;

wherein the diameter of the cutting faces of the first primary cutter element mounted to the first secondary blade is less than the diameter of the cutting face of the first primary cutter element mounted to the third primary blade.

14. The drill bit of claim 13 wherein each cutting face has an extension height, and wherein the extension height of the cutting face of the first primary cutter element mounted to the first secondary blade is less than the extension height of the cutting face of the first primary cutter element mounted to the third primary blade.

15. The drill bit of claim 6 wherein the cone region has a primary blade cutter redundancy percentage and the shoulder region has a primary blade cutter redundancy percentage that is less than the primary blade cutter redundancy percentage in the cone region.

16. The drill bit of claim 1 wherein each primary cutter element has an extension height, and wherein each primary cutter element has substantially the same extension height.

17. The drill bit of claim 1 wherein the first of the primary cutter elements on the first primary blade leads the first of the primary cutter elements mounted on the second primary blade relative to a direction of rotation of the bit body about the bit axis; and wherein the first primary blade includes an integral depth-of-cut limiter or a depth-of-cut limiter insert that trails the first of the primary cutter elements on the first primary blade relative to the direction of rotation of the bit body and is positioned at the same radial position as the first of the primary cutter elements on the first primary blade.

18. The drill bit of claim 1 wherein the first of the primary cutter elements on the first primary blade leads the first of the primary cutter elements mounted on the second primary blade relative to a direction of rotation of the bit body about the bit axis; and wherein the first primary cutter element on the first primary blade has a cutting face oriented at a first backrake angle and the first primary cutter element on the second primary blade has a cutting face oriented at a second backrake angle that is greater than the first backrake angle.

19. The drill bit of claim 1 further comprising a plurality of backup cutter elements mounted to the first primary blade in the shoulder region, each backup cutter element on the first primary blade being mounted in a different radial position;

wherein each backup cutter element on the first primary blade is disposed at a different radial position than each of the plurality of primary cutter elements mounted to the first primary blade.

20. The drill bit of claim 19 further comprising:

a first secondary blade extending along the bit face from the shoulder region to the gage region;

a plurality of primary cutter elements mounted to the first secondary blade, each primary cutter element on the first secondary blade being mounted in different radial position;

wherein a first primary cutter element of the plurality of primary cutter elements on the first secondary blade is redundant with one of the backup cutter elements mounted to first primary blade.

21. A drill bit for drilling a borehole in earthen formations, the bit comprising:

a bit body having a bit axis and a bit face including a cone region, a shoulder region, and a gage region;

a plurality of forward-facing primary cutter elements disposed in the cone region;

a plurality of forward-facing primary cutter elements disposed in the shoulder region;

a plurality of forward-facing primary cutter elements disposed in the gage region;

wherein a first and a second of the plurality of primary cutter elements in the cone region are disposed at the same radial position relative to the bit axis;

wherein a first and a second of the plurality of primary cutter elements in the shoulder region are disposed at the same radial position relative to the bit axis;

wherein the cone region has a total cutter redundancy percentage, the shoulder region has a total cutter redundancy percentage, and the gage region has a total cutter redundancy percentage; and wherein the total cutter redundancy percentage of the shoulder region is less than the total cutter redundancy percentage in the cone region and the total cutter redundancy percentage in the shoulder region is greater than a total cutter redundancy percentage in the gage region.

22. The drill bit of claim 21 wherein the gage region has a total cutter redundancy percentage that is less than the total cutter redundancy percentage in the cone region.

23. The drill bit of claim 22 wherein the total cutter redundancy percentage of the gage region is zero.

24. The drill bit of claim 21 wherein the total cutter redundancy percentage of the cone region is greater than 25%.

25. The drill bit of claim 21 wherein the first and the second of the plurality of primary cutter elements in the cone region are the only redundant cutter elements in the cone region.

26. The drill bit of claim 21 wherein the total cutter redundancy percentage in the shoulder region is greater than 0 and less than 25%.

27. The drill bit of claim 21 wherein a third and a fourth of the plurality of primary cutter elements in the shoulder region are disposed at the same radial position relative to the bit axis.

28. The drill bit of claim 21 wherein each cutter element has a primary cutting face with a diameter;

wherein the diameter of the first of the plurality of primary cutter elements in the shoulder region is greater than the diameter of the second of the plurality of cutter elements in the shoulder region.

29. The drill bit of claim 21 wherein each cutting face has an extension height, and wherein the extension height of first of the plurality of primary cutter elements in the shoulder region is greater than the extension height of the second of the plurality of primary cutter elements in the shoulder region.

30. The drill bit of claim 21 wherein the first of the plurality of primary cutter elements in the cone region leads the second of the plurality of primary cutter elements in the cone region relative to a direction of rotation of the bit body about the bit axis;

wherein the first of the plurality of primary cutter elements in the cone region has a cutting face oriented at a first backrake angle and the second of the plurality of primary cutter elements in the cone region has a cutting face oriented at a second backrake angle that is greater than the first backrake angle.

31. A drill bit for drilling a borehole in earthen formations, the bit comprising:

a bit body having a bit axis and a bit face including a cone region, a shoulder region, and a gage region;

a first primary blade extending radially along the bit face from the cone region to the gage region;

a plurality of primary cutter elements mounted to the first primary blade in different radial positions;

a second primary blade extending radially along the bit face from the cone region to the gage region;

a plurality of primary cutter elements mounted to the second primary blade in different radial positions;

wherein a first primary cutter element of the plurality of primary cutter elements on the first primary blade is redundant with a first primary cutter element of the plurality of primary cutter elements on the second primary blade;

wherein the cone region has a primary blade cutter redundancy percentage; and wherein the shoulder region has a primary blade cutter redundancy percentage that is less than the primary blade cutter redundancy percentage in the cone region.

32. The drill bit of claim 31 wherein the gage region has a primary blade cutter redundancy percentage that is less than the primary blade cutter redundancy percentage in the cone region.

33. The drill bit of claim 32 wherein the primary blade cutter redundancy percentage of the gage region is zero.

34. The drill bit of claim 32 wherein the primary blade cutter redundancy percentage of the cone region is greater than 25%.

35. The drill bit of claim 31 further comprising:

a third primary blade extending radially along the bit face from the cone region to the gage region;

a plurality of primary cutter elements mounted to the third primary blade in different radial positions;

a first secondary blade extending along the bit face from the shoulder region to the gage region;

a plurality of primary cutter elements mounted to the secondary blade in different radial positions; and wherein at least one of the plurality of primary cutter elements mounted to the third primary blade is redundant with at least one of the plurality of primary cutter elements mounted to the first secondary blade.

36. The drill bit of claim 35 wherein a second of the plurality of primary cutter elements mounted to the third primary blade is redundant with a second of the plurality of primary cutter elements mounted to the first secondary blade.

37. The drill bit of claim 35 wherein the gage region has a primary blade cutter redundancy percentage that is less than the primary blade cutter redundancy percentage in the shoulder region.

38. The drill bit of claim 35 wherein the primary blade cutter redundancy percentage in the shoulder region is between 0 and 25%.

39. The drill bit of claim 31 wherein each primary cutter element has a primary cutting face with a diameter, wherein the diameter of each primary cutting face is substantially the same.

* * * * *